US006109545A

United States Patent [19]

Kah, Jr.

[11] Patent Number: 6,109,545

[45] **Date of Patent: *Aug. 29, 2000**

[54] CLOSED CASE OSCILLATING SPRINKLER

[76] Inventor: Carl L. C. Kah, Jr., 778 Lakeside Dr., N. Palm Beach, Fla. 33408

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/863,739

[22] Filed: May 27, 1997

Related U.S. Application Data

[60] Division of application No. 08/269,342, Jun. 30, 1994, Pat. No. 5,653,390, which is a continuation-in-part of application No. 07/724,406, Jun. 28, 1991, abandoned, which is a continuation-in-part of application No. 06/932,470, Nov. 18, 1986, Pat. No. 5,417,370.

[51] Int. Cl.[7] ..... B05B 3/16

[52] U.S. Cl. ..... 239/242; 74/354

[58] Field of Search ..... 239/237, 240, 239/242, 255, 263.3, 73; 74/354

[56] References Cited

U.S. PATENT DOCUMENTS

| | | | |
|---|---|---|---|
| 1,481,706 | 1/1924 | Goodwin . | |
| 2,187,549 | 1/1940 | Thompson . | |
| 3,038,666 | 1/1962 | Dudley et al. . | |
| 3,383,047 | 5/1968 | Hauser . | |
| 3,526,363 | 9/1970 | Hauser . | |
| 3,645,451 | 2/1972 | Hauser | 239/242 X |
| 3,655,132 | 4/1972 | Rosic . | |
| 3,785,565 | 1/1974 | Perry et al. . | |
| 3,874,588 | 4/1975 | Flynn . | |
| 3,924,820 | 12/1975 | Kovar et al. . | |
| 4,253,608 | 3/1981 | Hunter . | |
| 4,417,691 | 11/1983 | Lockwood . | |
| 4,568,024 | 2/1986 | Hunter | 239/242 |
| 4,624,412 | 11/1986 | Hunter . | |
| 4,625,914 | 12/1986 | Sexton et al. . | |
| 4,634,052 | 1/1987 | Grizzle et al. . | |
| 4,650,118 | 3/1987 | Saarem et al. . | |
| 4,718,605 | 1/1988 | Hunter | 239/242 |
| 4,773,595 | 9/1988 | Livine . | |
| 4,892,252 | 1/1990 | Bruninga . | |
| 4,919,337 | 4/1990 | Van Leeuwen et al. . | |
| 4,925,098 | 5/1990 | Di Paola . | |
| 5,115,977 | 5/1992 | Alkalay et al. . | |

*Primary Examiner*—Lesley D. Morris

*Attorney, Agent, or Firm*—Ostrolenk, Faber, Gerb & Soffen, LLP

[57] ABSTRACT

An oscillating sprinkler head transmission for alternately driving an output shaft and sprinkler head nozzle to oscillate it with spring bias being provided to prevent the transmission from being placed in an inoperative position, where the sprinkler head is not oscillated.

59 Claims, 28 Drawing Sheets

CLOSED CASE OSCILLATING SPRINKLER

This application is a division of application Ser. No. 08/269,342, filed Jun. 30, 1994, now U.S. Pat. No. 5,653,390 which was a Continuation-in-Part of application Ser. No. 07/724,406, filed Jun. 28, 1991 (now abandoned), which was a Continuation-in-Part of application Ser. No. 06/932,470, filed Nov. 18, 1986, now U.S. Pat. No. 5,417,370.

TECHNICAL FIELD

This invention relates to transmission devices having a rotary input shaft and oscillating output shaft, including a device to change the angle of oscillation, such as used in rotary sprinkler heads for irrigation where water causes the sprinkler to rotate in order to provide water precipitation over a desired area.

BACKGROUND ART

Oscillating transmission devices for rotatable sprinklers have been known in the prior art for use in irrigation. Patents setting forth a background for this invention are: U.S. Pat. Nos. 3,038,666; 3,107,056; 3,645,451; 3,713,584; 3,724,757; 3,854,664; 4,272,024; 4,353,507; 4,568,024; 4,624,412; 4,625,914; 4,634,052; 3,383,047; 3,526,363; and 5,115,977.

CROSS REFERENCE

Patent application Ser. No. 932,470, filed Nov. 18, 1986, now U.S. Pat. No. 5,417,370, for "A TRANSMISSION DEVICE HAVING AN ADJUSTABLE OSCILLATING OUTPUT"; patent application Ser. No. 037,704, filed Apr. 13, 1987, now U.S. Pat. No. 4,867,378, for a "SPRINKLER DEVICE"; patent application Ser. No. 183,071, filed Apr. 19, 1988, now U.S. Pat. No. 4,901,924, for a "SPRINKLER DEVICE WITH ANGULAR CONTROL"; patent application Ser. No. 245,126, now U.S. Pat. No. 4,955,542, for a "REVERSING TRANSMISSION FOR OSCILLATING SPRINKLERS"; and patent application Ser. No. 626,993, filed Dec. 13, 1990, now U.S. Pat. No. 5,148,991, for a "GEAR DRIVEN TRANSMISSION FOR OSCILLATING SPRINKLER", all filed by Carl L. C. Kah, Jr., are related to this divisional application of patent application Ser. No. 08/269,342.

BACKGROUND OF THE INVENTION

Patent application Ser. No. 932,470, now U.S. Pat. No. 5,417,370, discusses the need to maintain a continuous bias on the reversing transmission's gear cage which alternately shifts a pair of terminal gears carried on a gear cage assembly into and out of engagement with an output shaft ring gear during the period that a reversing toggle is being moved over its reversing overcenter position. Maintaining a bias on the driving terminal gear insures that it will not become disengaged during stopping or starting of the drive when the reversing toggle bias has been lifted off.

Also disclosed was a reversing gear drive configuration in which the driving pinion was always engaging the output gear with the reaction force on the driving terminal pinion gear tending to hold the driving gears in engagement with the driving input gear during driving in either direction and input shaft torque is not applied to the shiftable gear cage in a manner to cause the gear cage to be disengaged in either of its driving engagement positions.

In my U.S. Pat. No. 5,148,991, issued Sep. 22, 1992, several oscillating sprinkler drive configurations are shown having a shiftable gear cage bias means for continuously biasing the gear cage towards one driving engagement direction or the other up to the moment the gear cage is shifted overcenter.

DISCLOSURE OF INVENTION

An object of this invention is to have a transmission for alternately driving an output gear to oscillate it, by one driving gear and then another, with spring means being provided to prevent the transmission from being placed in an "off" position with neither driving gear positioned to drive the output gear upon starting.

Another object of this invention is to have an oscillating transmission with a pivoted gear cage having two drive gears, a first clockwise drive gear and a second counter-clockwise drive gear, for alternate driving engagement with an output gear to oscillate it, a first and second overcenter spring means act on said gear cage in one direction to place one drive gear into driving engagement with said output gear while placing said other drive gear out of driving engagement. To reverse the position of the drive gears, the first spring means has its biasing force removed from the gear cage to be placed in an overcenter position to bias the gear cage in the opposite direction so that the other drive gear can be placed in driving engagement with said output gear and the one drive gear can be placed out of driving engagement, said second spring means retaining the one drive gear in driving engagement until the first spring means is biasing the gear cage to the reverse position and has overcome the second spring means to place it in an overcenter position; the second spring means thus acts together with the first spring means to pivot said gear cage to its reverse position. The second overcenter spring means insures that during the time that the pivoted gear cage is not being biased by the first overcenter spring means that it remains in one driving position or the other, and cannot be left in a "dead-center" position where neither of the two drive gears is in driving engagement with said output gear.

A further object of this invention is to provide an oscillating transmission which has an angular positioning member for directly setting the oscillating angle and a shaft with an adjusting, or setting, slot accessible on the top of an oscillating output cap. The slot has an arrowhead at one end indicating the position of an adjustable reversing actuator within the transmission, and an arrowhead is placed on the top of the output cap indicating the position of a fixed reversing actuator within the transmission. Indicia representing angles can be placed around the output cap to aid in positioning the setting slot at a desired angle. The ability to look at the adjustable angular selection dial and see at a glance what arc a particular unit is set for, provides an enhanced marketability for products using this drive, especially in the sprinkler field. When used as a sprinkler device, the sprinkler devices can be removed from a lawn location for cleaning or inspection and when it is desired to reinstall the sprinkler device, the desired angle of oscillation can easily be set by simply looking at the top of the device and if it is not already properly set, a rotatable member can be pointed at the desired angle position indicated on the top of the sprinkler device.

Another object of this invention is to provide for a driving connection between a rotating input shaft and an output gear for oscillating the output gear and providing for changing the angle of oscillation. The output gear has a fixed projection thereon to reverse rotation at one side of the angle and a cylindrical member mounted for rotation with said output gear has an adjustable projection to reverse rotation at the other side of this angle, relative rotation of said cylindrical member with said output gear changing said angle of oscillation.

A further object of this invention is to provide an oscillating transmission having a ring gear mounted for rotation with means for oscillating said ring gear; a toggle means reverses the rotation of said ring gear from one direction to the other, with contact means rotated by said ring gear engaging said toggle means to reverse rotation from one direction to the other, said contact means are two projecting members, with means mounting said two projecting members for relative movement to vary the angle at which said toggle means is actuated, said one projecting member being mounted on said ring gear while said other projecting member is mounted for rotation within said ring gear. Means connect said other projecting member to said ring gear for being driven thereby to contact said toggle means to reverse rotation of said ring gear, and means disconnect said other projecting member from said ring gear when said other projecting member is rotated to vary the angle between the projecting members.

An object of this invention is to provide a transmission having an oscillating output ring gear with a hollow shaft at the center thereof, said oscillating hollow shaft providing the output of the transmission such as by a gear attached thereto, a cylindrical member being mounted for rotation with said hollow shaft, an adjustable projection extending from said cylindrical member to serrations on the interior of said ring gear for contacting an actuating means to reverse transmission direction, said serrations connecting said adjustable projection to said ring gear for being driven thereby, said serrations providing for relative movement when said cylindrical member is rotated to vary the angle of rotation; said cylindrical member can be rotated directly through the hollow shaft.

Another object of this invention is to provide a torque-limiting member between said cylindrical member and said hollow shaft for providing for rotation of said cylindrical member without placing undue forces on any other operating parts.

Another object of this invention is to provide an oscillating transmission having an oscillating ring gear with a hollow shaft at the center thereof, said oscillating hollow shaft providing the output of the transmission, a nozzle head oscillated by said ring gear for receiving a flow of water through said transmission.

A further object of this invention is to provide an improved oscillating drive having a reversing gear cage and toggle device mounted on a base member for oscillation, said gear cage having two spaced driving gears always engaging an output gear with one spaced driving gear having an idler gear, either driving gear is driven by a spur gear on an input shaft located in the space between one driving gear and idler gear to drive the output gear, said input shaft extending through said space from said base member with a sleeve therearound with said gear cage having an elongated opening around said sleeve, the length of the elongated opening determining the engagement of the teeth of the spur gear with its cooperating driving gear or idler gear to prevent excessive or unnecessary interaction between the gears.

Another object of this invention is to provide an improved oscillating drive having a reversing gear cage wherein said gear cage is alternately biased by first biasing means in one or the other of two driving positions to provide for oscillating movement, second means being provided for biasing said gear cage in one of said directions to maintain a driving engagement when said first biasing means has been removed.

A further object of this invention is to provide an improved oscillating drive having a reversing gear cage with two spaced driving gears always engaging an output gear; either driving gear is driven by an input shaft, located in the space between the driving gears, to drive the output gear; the reaction force on the driving gear tends to hold the reversing gear cage and driving gear into engagement with the input shaft.

Another object of this invention is to provide an improved oscillating drive having a toggle device mounted on a base member for oscillation, stops are provided between said toggle device and base member for (1) limiting the biasing load on gears during operation; and (2) providing ease of spring insertion during assembly.

A further object of the invention is to apply the important concept of continuous gear cage engaging bias toward driving engagement for reversing transmissions used in oscillating sprinkler drives to ensure proper operation under all conditions of operation, setting, handling, and installation.

Another object of the invention is to provide a simplified shiftable pinion gear configurations in which, the shiftable gear cage which now is only a shiftable gear carrier for a single driving pinion gear and which remains in constant engagement with the output ring gear is shifted about the output ring gear center to engage one or the other of two counter rotating input shafts to achieve the reverse driving action. An overcenter driving engaging bias is provided which will insure the proper driving position of the driving pinion carrier until shifted to its reversed position by a shifting arm which has a lost motion connection to allow the shifting arm to be moved over it's overcenter biasing spring position before it engages the carrier to shift it out of driving engagement and carry it over its center so that the gear cage carrier's overcenter bias can then be applied in the reversed direction to carry the gear cage (carrier) into its full driving position in a reversed driving direction and maintain the driving pinion gear in proper reverse driving position until again shifted to provide driving engagement in the opposite direction.

Another transmission configuration is also shown where the reversing toggle's overcenter bias is a single spring and is also used to directly bias the gear cage assembly in its driving position in either direction. At the bias spring neutral center position of the reversing toggle, any gear cage movement towards premature disengagement of the driving terminal gear changes the overcenter relationship of the single overcenter reversing biasing spring, (acting on the single driving pinion gear cage (carrier)) to reverse the direction of its engaging bias and causes the driving pinion gear cage (carrier) to be shifted to its reversed driving position causing the desired reversing action while maintaining the driving engaging bias up to the moment of the reversing action occurring and then reapplying it in the reversed direction.

A third transmission configuration is shown where the overcenter carry action of a shifting arm is provided by the deflection of a spring member which carries the driving pinion gear cage (carrier) member overcenter once it has been driven out of driving engagement by the action of one of the arc control contact members being driven against the spring member shifting arm.

Because of the need to minimize the outside diameter of the gear drive assembly to reduce the sprinklers housing size and pressure surface and the central flow area needed to get water to the sprinklers oscillating nozzle a very compact and simple reversing gear arrangement is needed. Also the sprinkler mechanism needs to operate reliably for a long period of time in a very harsh environment of dirt and dirty water with no corrective attention. It is an object of this invention to provide improved and simplified reversing drive means for oscillation nozzle sprinklers for high reliability and more liberal manufacturing tolerances and ease of reliable product assembly.

Another object of this invention is to provide an improved oscillating drive reversing gear mechanism with two oppositely rotating input shafts spaced apart with a shiftable gear carrier (cage) for a single driving pinion gear which is shifted between engagement with one or the other of the counter rotating input shafts and the output drive gear to achieve the reversing drive of the output shaft. The reaction force of the driving gear on the driving pinion gear and shiftable gear cage carrier tends to hold the reversing gear cage and driving gear into engagement with the input gear in either of its driving positions.

Another object of the invention is to provide a reliable, simplified oscillation sprinkler transmission where the reversing gearing may be replaced by a friction rubber wheel drive to provide a friction driving connection between the input shaft and the output drive means. This can also provide the clutching action to prevent damage to the gear drive if the nozzle and output shaft is force rotated. The manufacturing tolerances would also be much less restrictive for a friction drive than a pure reversing gear drive and have substantially fewer parts than the slip clutch to output shaft arrangement described and shown for the pure gear drive. These features are a further object of the invention.

BRIEF DESCRIPTION OF INVENTION

Figure 25:
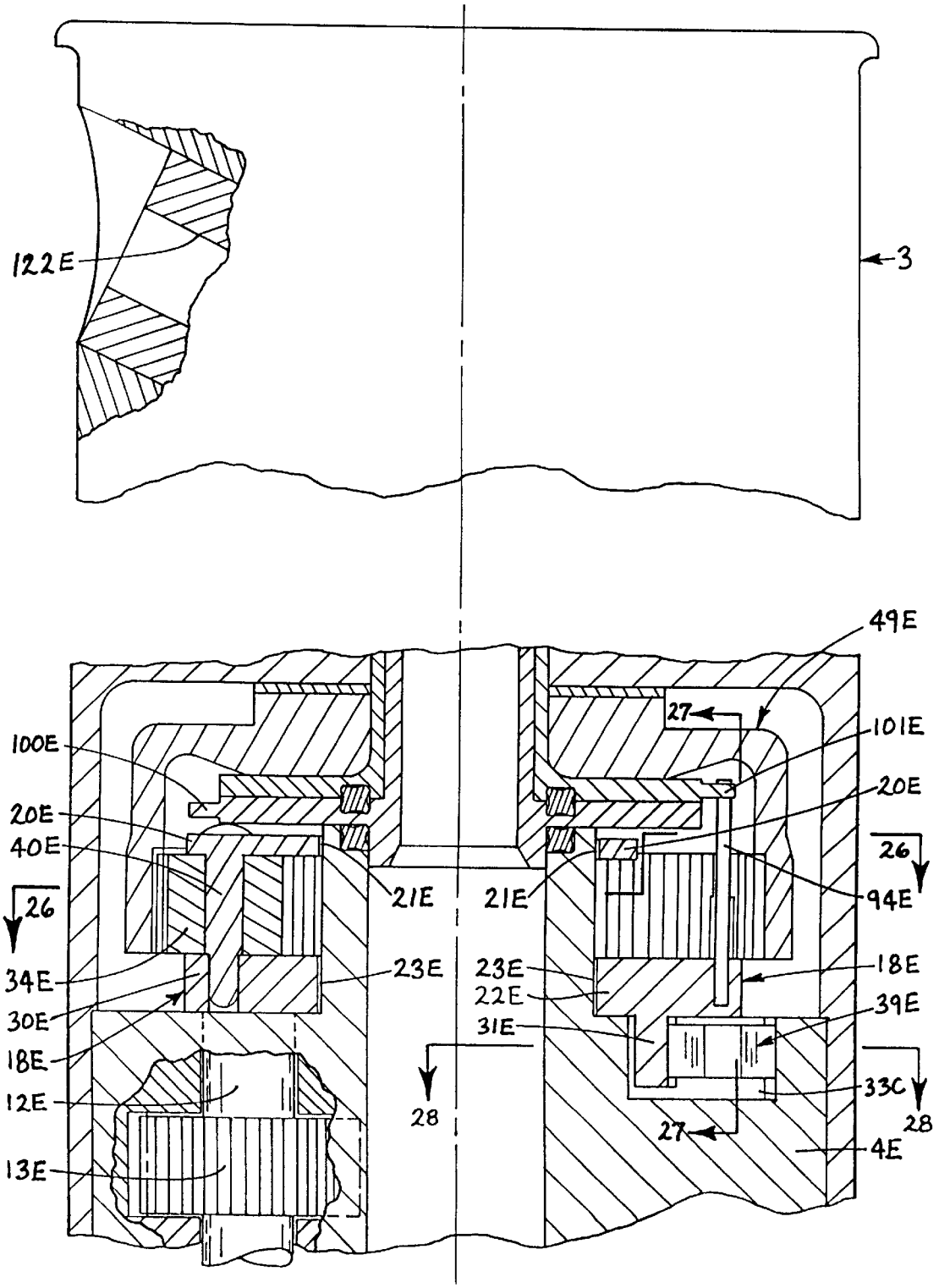
FIG. 25 is a fragmentary side elevation view of a sprinkler showing the upper rotating nozzle and reversing drive in section for a reversing mechanism which has no toggle shifting arm and is shown with gear cage (carrier) with its bias spring seats aligned.
Figure 27:
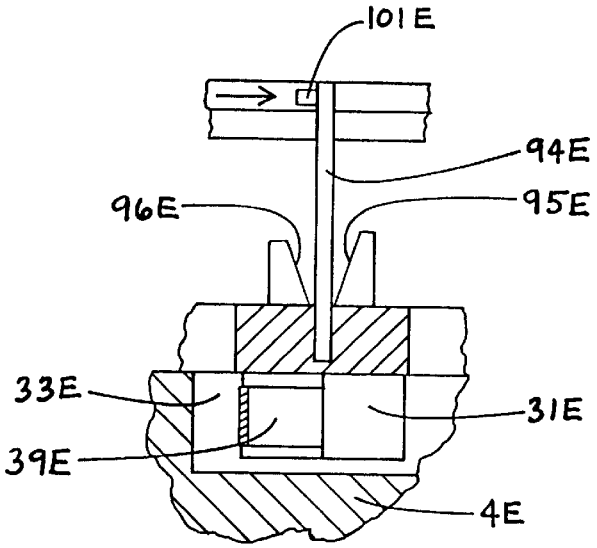
Figure 28:
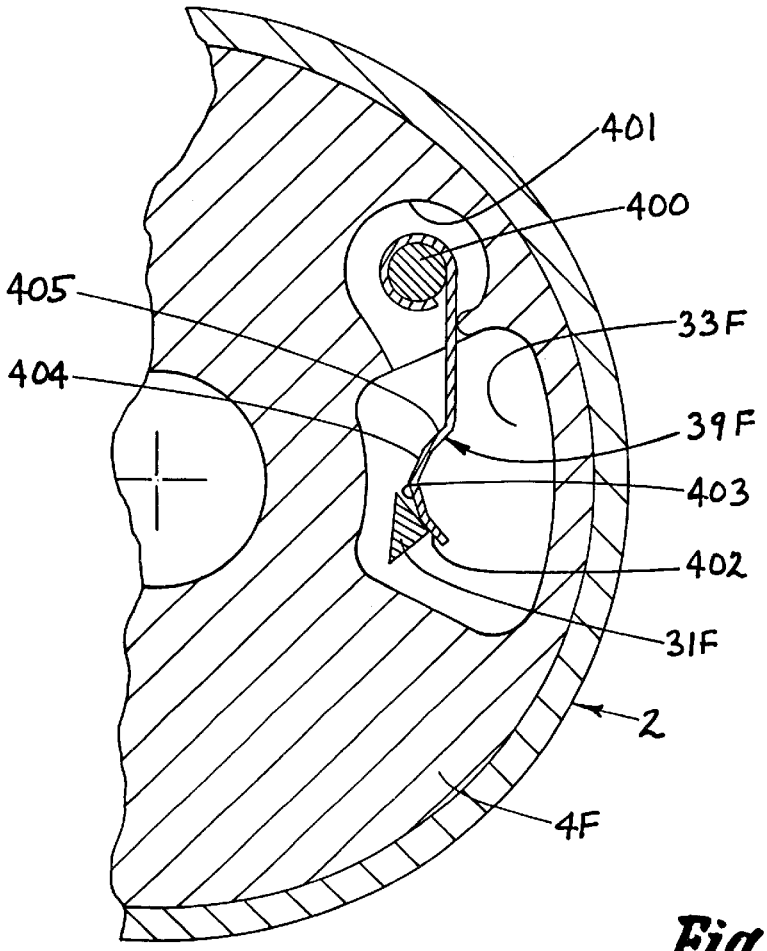

FIG. 27 is a partial side elevation view looking generally along line 27—27 of FIG. 25 with the output driving member and other parts removed, showing the reversing gear cage actuation arm wire and side stiffening posts extending upwardly from the top surface of the gear cage bottom plate as well as the position of the integral gear cage over-center biasing spring positioned below the gear cage bottom plate as shown in FIG. 25;

FIG. 28 is a partial transverse sectional view of the transmission device taken along line 28—28 of FIG. 25 showing an alternate configuration of gear cage biasing spring with shaped contact surface interacting on a camming post carried by the gear cage to provide a variable gear cage bias force.

Figure 29:
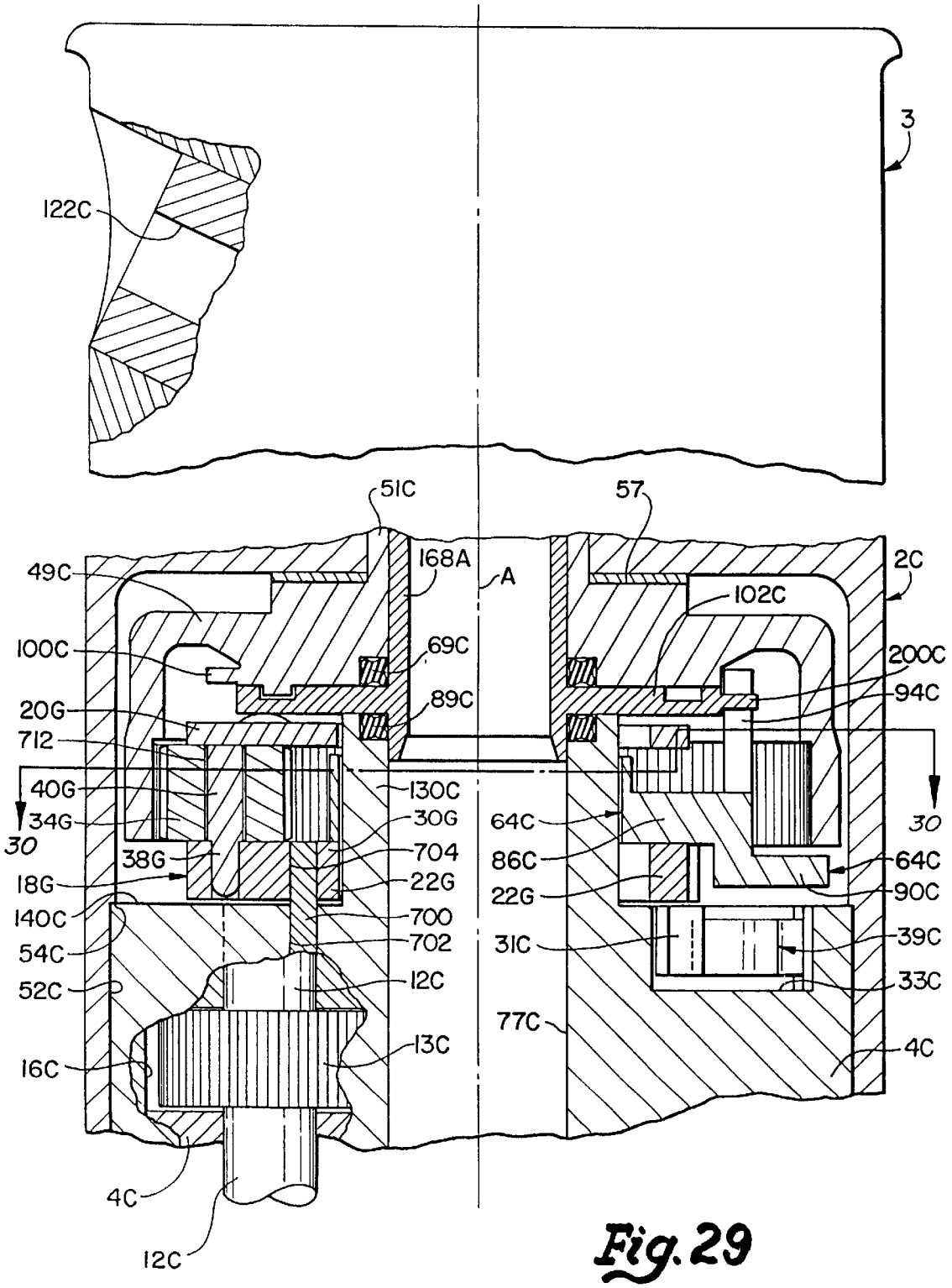
Figure 30:
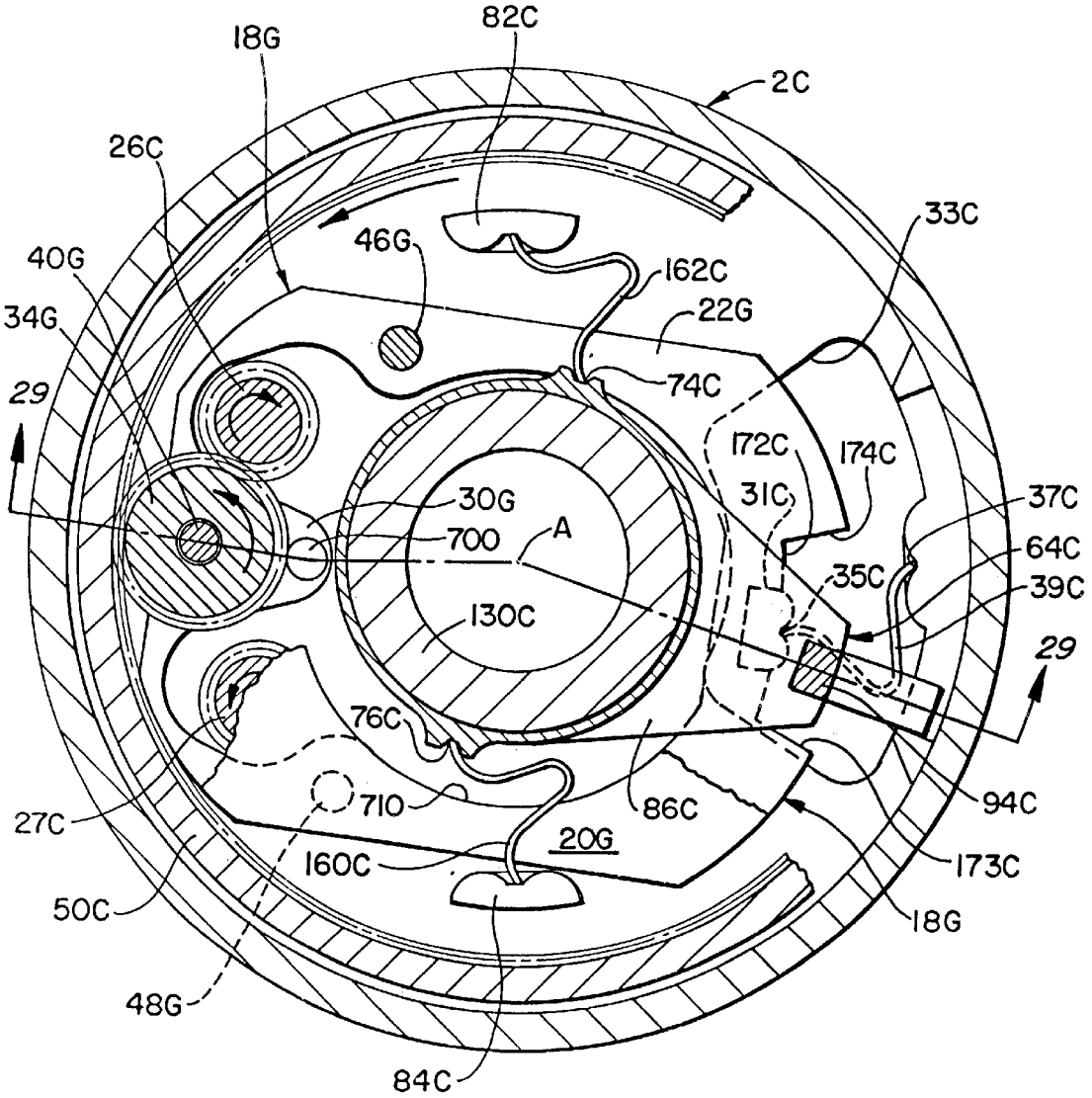

FIG. 29 is taken on line 29—29 of FIG. 30;

FIG. 30 is taken on line 30—30 of FIG. 29.

BEST MODE FOR CARRYING OUT THE INVENTION

Figure 1:
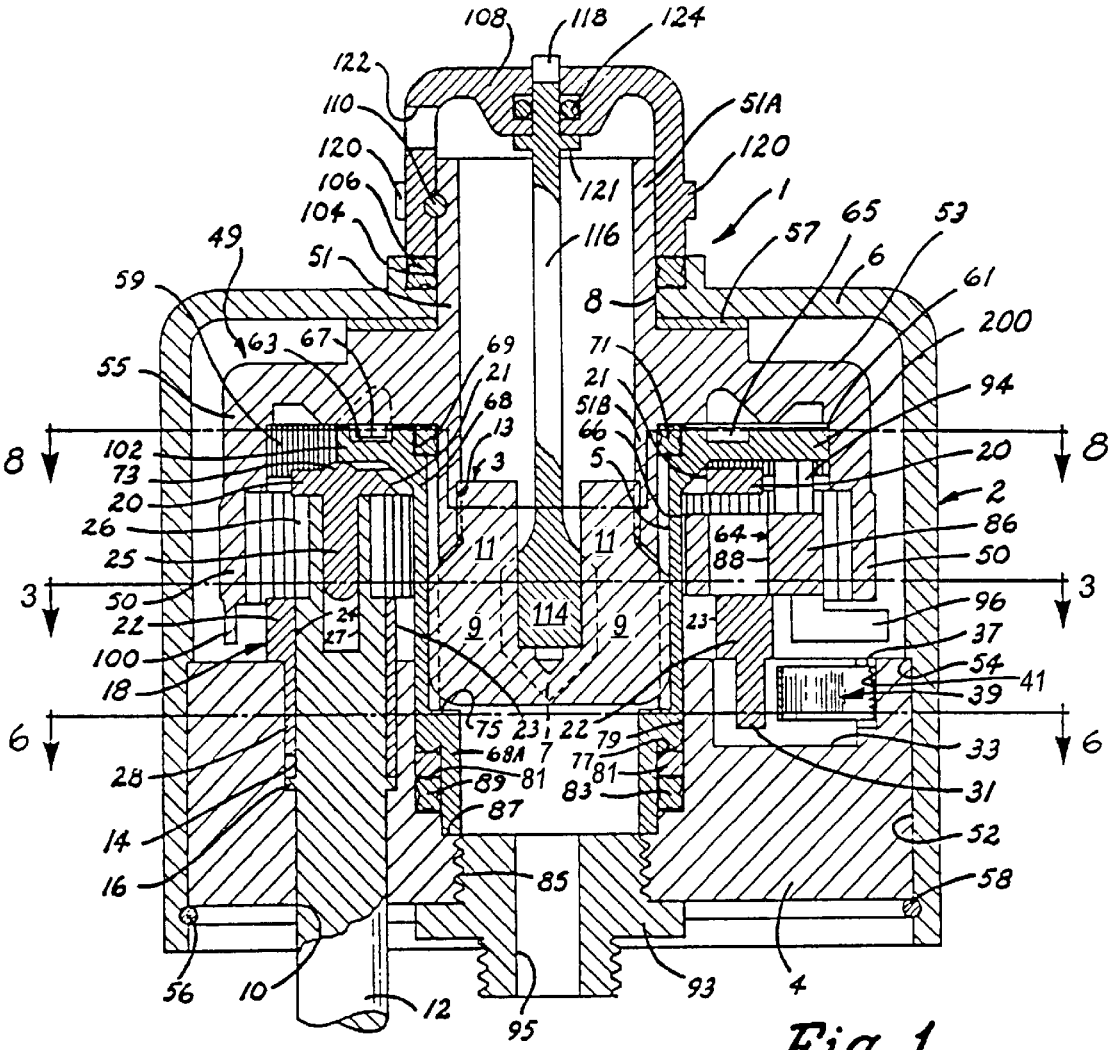
FIG. 1 is an elevational view in section of a transmission device showing the input drive shaft and output cap, the reversing gear cage and reversing toggle being positioned as shown in FIG. 8, with the reversing gear cage spring means shown in full where it engages the base member.

Referring to FIG. 1 of the drawings, a sprinkler transmission device 1 is shown having a cylindrical housing 2 positioned over and fixed to a base member 4. Cylindrical housing 2 has an integral cover 6 having a center outlet opening 8 for a purpose to be hereinafter described. The end of cylindrical housing 2 over base member 4 has a circumference of an increased inner diameter 52 forming an annular step 54. Base member 4 is positioned in the increased diameter 52 of cylindrical housing 2 against the annular step 54 and an internal snap ring 56 is placed in an annular groove 58 in the circumference of increased inner diameter 52 formed at the bottom of base member 4 to fix it in place. Other holding means can be used.

Base member 4 has an opening 10 therethrough positioned to one side for receiving a rotary input shaft 12. Rotary input shaft 12 can be driven by a fluid turbine. The upper part 14 of the opening 10 is enlarged to receive an annular flange 16 on the input shaft 12. A reversing gear cage 18 is positioned within said cylindrical housing 2 adjacent said base member 4 and the reversing gear cage or shiftable carrier 18 is formed having a top plate 20 and a bottom plate 22 with cooperating center openings 21 and 23, respectively. The bottom plate 22 has an opening 24 therein to receive the rotary input shaft 12, the upper end of which is formed as a spur gear 26. A cylindrical shaft 28 extends downwardly from the bottom of the bottom plate 22 around opening 24 and extends into the upper part 14 of the opening 10 to provide for pivotal movement of the reversing gear cage 18 while the cylindrical shaft 28 properly positions the input shaft 12 and spur gear 26 above the top of the bottom plate 22 by enclosing the annular flange 16. An integral shaft 25 extends downwardly from the bottom of top plate 20 to engage a cylindrical opening 27 extending downwardly from the top of input shaft 12 through the centerline of the spur gear 26.

Figure 3:
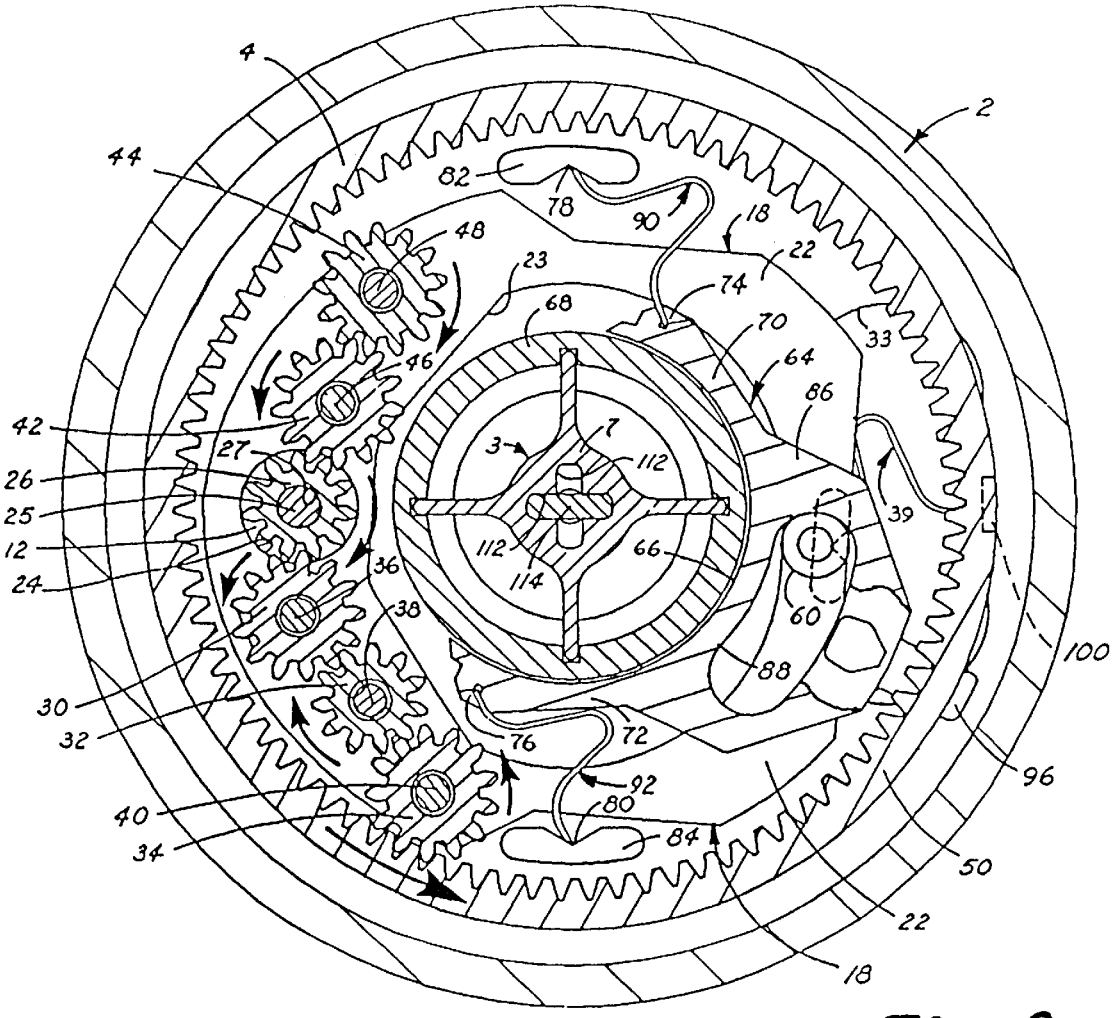
FIG. 3 is a transverse sectional view of the transmission device taken along a plane represented by the line 3—3 of FIG. 1 showing the reversing gear cage and reversing toggle, each biased clockwise to one side with a driving gear of the reversing gear cage engaging the ring gear on the output member for counter-clockwise drive.
Figure 4:
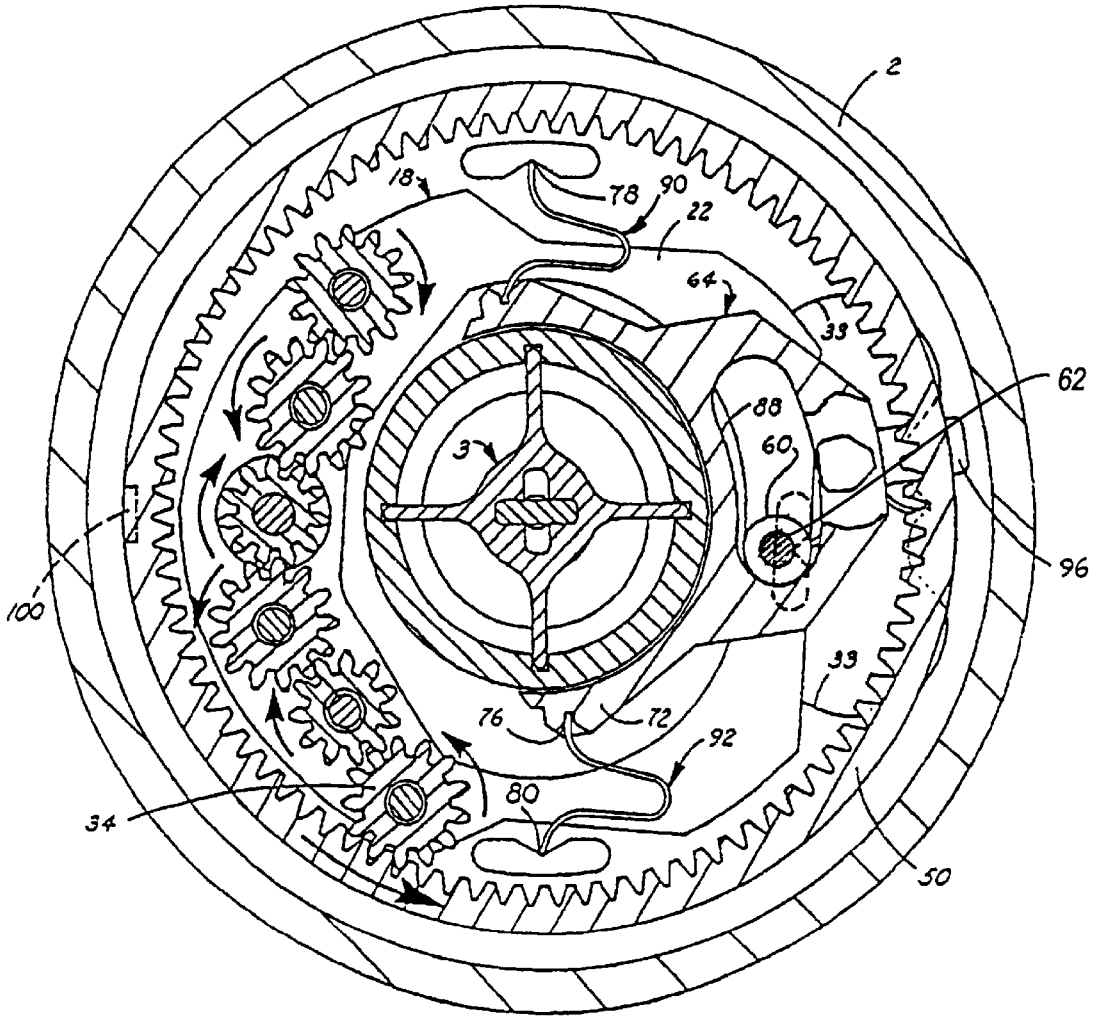
FIG. 4 is a transverse sectional view of the transmission device taken along a plane represented by the line 3—3 of FIG. 1 showing the reversing toggle forced counter-clockwise to a position where the reversing toggle has just passed over a center line reversing the biasing forces on said reversing toggle.
Figure 5:
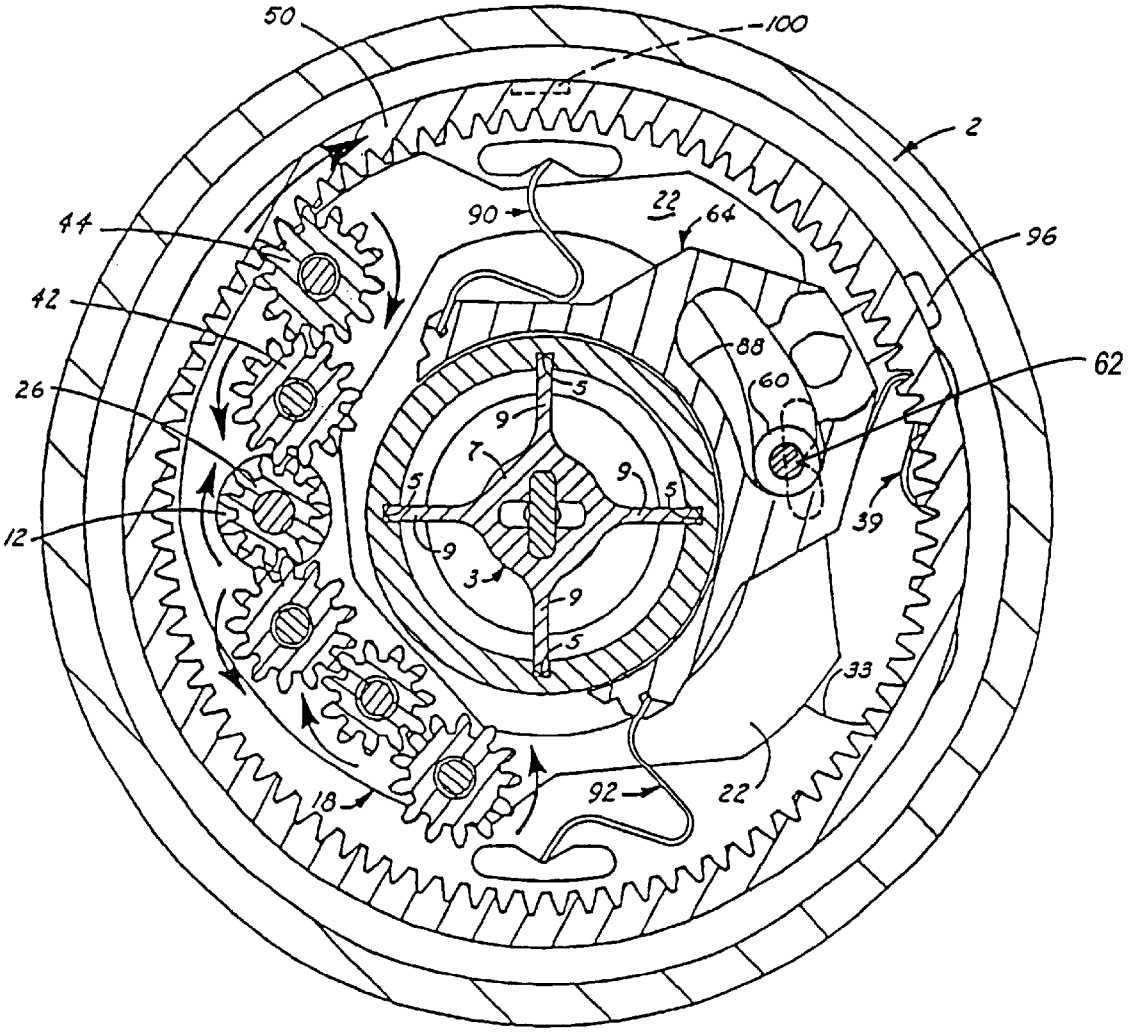
FIG. 5 is a transverse sectional view of the transmission device taken along a plane represented by the line 3—3 of FIG. 1 showing the reversing gear cage and reversing toggle, each biased counter-clockwise to the other side with an opposite driving gear of the reversing gear cage engaging the ring gear on the output member for clockwise drive.

As shown in FIGS. 3, 4 and 5, three gears 30, 32 and 34 are mounted on integral shafts 36, 38 and 40 extending downwardly from top plate 20 of the reversing gear cage 18 and they extend in a counter-clockwise direction from the integral shaft 25. Integral shaft 36 is positioned so that gear 30 will engage the spur gear 26; shaft 38 is positioned so that gear 32 will engage gear 30; and shaft 40 is positioned so that gear 34 engages gear 32 and extends outwardly over the edges of top plate 20 and bottom plate 22 so that it can drivingly engage an output ring gear 50, encircling the reversing gear cage 18 between the top plate 20 and bottom plate 22. Output ring gear 50 is formed as a part of output member 49. Output member 49 will be hereinafter discussed as to its structure and use.

Two gears 42 and 44 are mounted on integral shafts 46 and 48 extending downwardly from top plate 20 of the reversing gear cage 18 and they extend in a clockwise direction from the integral shaft 25. Integral shaft 46 is positioned so that gear 42 will engage the spur gear 26 and shaft 48 is positioned so that gear 44 engages gear 42 and extends outwardly over the edges of top plate 20 and bottom plate 22 so that it can drivingly engage said output ring gear 50. Integral shafts 36, 38, 40, 46 and 48 of top plate 20 extend into matched openings in bottom plate 22 and have a snap engagement at their ends with said openings to fix said top plate 20 and bottom plate 22 of the reversing gear cage 18 together.

A hollow actuating post 60 extends upwardly from the top of the bottom plate 22 at a point on the other side of the center opening 23 from the opening 24, and on a radial line passing through the center of the opening 24; said arrangement permits arcuate movement of hollow actuating post 60 about the center of opening 24, cylindrical shaft 28 and spur gear 26, as reversing gear cage 18 is moved between its clockwise driving position and counter-clockwise driving position. A short integral shaft 62 extends downwardly from the bottom of top plate 20 to have snap engagement with the hollow actuating post 60.

It can be seen that when the reversing gear cage 18 is positioned clockwise around input shaft 12, as shown in FIG. 3, the gear 34 is engaging the ring gear 50. With the rotary input shaft 12 being driven clockwise, the two idler gears 30 and 32 will rotate drive gear 34 counter-clockwise, imparting a counter-clockwise rotation to output ring gear 50. When the reversing gear cage 18 is positioned counter-clockwise around input shaft 12, as shown in FIG. 5, the gear 44 is engaging the ring gear 50. With the rotary input shaft 12 being driven clockwise, the one idler gear 42 will rotate the drive gear 44 clockwise, imparting a clockwise rotation to output ring gear 50.

To bias the reversing gear cage 18 in a clockwise direction to have gear 34 engage ring gear 50, or bias the reversing gear cage 18 in a counter-clockwise direction to have gear 44 engage ring gear 50 for oscillating movement of output ring gear 50, a reversing toggle device 64 is positioned between the top plate 20 and bottom plate 22 of reversing gear cage 18. The reversing toggle device or shiftable member 64 is formed having a C-shape with an arcuate inner surface 66 greater than 180 degrees for rotation about a cylindrical member 68, extending through the center openings 21 and 23 of top plate 20 and bottom plate 22 of reversing gear cage 18. Cylindrical member 68 will be hereinafter discussed as to its structure and use.

The C-shape of reversing toggle device 64 has two arms 70 and 72 with spring seat notches on their outer surface at 74 and 76, respectively; said spring seat notches 74 and 76 being 180 apart. Cooperating spring seat notches 78 and 80 are placed on projections 82 and 84, extending upwardly from the top surface of base member 4, adjacent the gear teeth of output ring gear 50. The spring seat notches 78 and 80 are located on a diametrical line through the centerline of the cylindrical housing 2, said diametrical line being 90 degrees to a line passing between the center of opening 24 of bottom plate 22 and the centerline of the cylindrical housing 2.

An overcenter spring means 90 extends between spring seat notch 74 on reversing toggle device 64 and spring seat notch 78 on projection 82 of base member 4, and a cooperating overcenter spring means 92 extends between spring seat notch 76 on reversing toggle device 64 and spring seat notch 80 on projection 84 of base member 4. Spring means 90 and 92 bias reversing toggle device 64 in a clockwise direction as viewed in FIG. 3, and in a counter-clockwise direction as viewed in FIG. 5. The action of these spring means 90 and 92 reverses when seat notches 74 and 76 pass on either side of a centerline passing through the spring seat notches 78 and 80.

Reversing toggle device 64 has a relatively wide radial arm 86 extending outwardly from the center portion thereof between the arms 70 and 72, to a location spaced inwardly from the gear teeth of ring gear 50. An arcuate opening 88 is placed in said radial arm 86 at a radius to receive the hollow actuating post 60 of the reversing gear cage 18.

Movement of toggle device 64 in either clockwise or counter-clockwise direction to just over its centerline position, reverses the biasing direction of each overcenter spring means 90 and 92, changing the biased position of toggle device 64. Toggle device 64 has an end of arcuate opening 88 which contacts hollow actuating post 60 to bias the reversing gear cage 18 in the same direction as the toggle device 64 changing the reversing gear cage 18 drive connection to output ring gear 50. It can be seen that this movement of toggle device 64 controls movement of reversing gear cage 18 between clockwise and counter-clockwise movement.

The radial arm 86 of reversing toggle device 64 has an upstanding projection 94 for rotating said toggle device 64 in a counter-clockwise direction and an outwardly extending radial projection 96 for rotating said toggle device 64 in a clockwise direction to move it to the overcenter position where the overcenter spring means 90 and 92 take over and bias the toggle device 64 and, in turn, reversing gear cage 18 to its engaged position with output ring gear 50. Upstanding projection 94 extends upwardly from the end of the top of radial arm 86 to a point above the teeth of the ring gear, and the outwardly extending radial projection 96 extends from the bottom of the radial arm 86 and under the output ring gear 50 adjacent its lower edge. Actuation of projection 94 and 96 will be hereinafter described.

To maintain a biasing force on reversing gear cage 18 at all times, to keep a driving gear 34 or 44 into engagement with ring gear 50, a downwardly projecting member 31 is located on the bottom of bottom plate 22 of the reversing gear cage 18 and extends into a recess 33 formed in the top of base member 4. Downwardly projecting member 31 is positioned below the actuating post 60 with a spring seat notch 35 facing outwardly along a radial line through the center of cylindrical shaft 28. A cooperating spring seat notch 37 is positioned on the outer wall of recess 33 on a line passing through the center of cylindrical shaft 28 and the center of the cylindrical housing 2. An overcenter spring means 39 extends between spring seat notch 35 on downwardly projecting member 31 and spring seat notch 37 on the outer wall of recess 33. Overcenter spring means 39 (and spring means 90 and 92) are formed from ribbon-like spring material, for example, steel, and shaped with an intermediate arcuate portion and oppositely directed straight portions to engage spring seat notches. Each end of the straight portions have serrations 41 to grip the spring seat notches. Overcenter spring means of this type, and others, are shown in U.S. Pat. Nos. 3,713,584; 3,724,757; and 3,107,056. Other types of overcenter spring means can be used such as coil springs, leaf springs, springs that have circular cross sections rather than those made from ribbon-like material shaped with an intermediate arcuate portion and oppositely directed straight portions. The biasing force of overcenter spring means 39 is made less than the combined biasing force of overcenter spring means 90 and 92, so that overcenter spring means 39 will only maintain the driving gear of reversing gear cage 18 in engagement until the overcenter spring means 90 and 92 actually go over center and force the toggle device 64 to the other side, the toggle device 64 contacting the actuating post 60 of the reversing gear cage 18 to carry the reversing gear cage 18 with it, breaking loose the driving gear from ring gear 50, at which time spring means 90 and 92 overpower the spring means 39, carrying the gear cage 18 overcenter to reverse the biasing force of spring means 39, spring means 90, 92, and 39, biasing the opposite driving gear of gear cage 18 into engagement. This prevents the reversing gear cage 18 from becoming positioned with both drive gears 34 and 44 out of engagement with ring gear 50. The reversing gear cage spring means 39 thus ensures that the drive gear of the reversing gear cage 18 remains engaged with ring gear 50 during stopping and starting torque changes through the range of rotational arcs where the gear cage 18 is not biased by the toggle device 64 loading against post 60 to hold the drive train in engagement.

Output ring gear 50 and cylindrical member 68 are mounted for rotation with each other in cylindrical housing 2 in either a clockwise or counter-clockwise direction. A fixed projection 100 extends downwardly from the bottom edge of output ring gear 50 to contact the outwardly extending radial projection 96 when ring gear 50 is being driven in a clockwise direction by gear 44 of reversing gear cage 18 (see FIG. 5). This movement of radial projection 96, as described hereinbefore, moves toggle device 64 just over its centerline position and spring means 90 and 92 take over as the driving engagement of gear 44 is broken and spring means 90 and 92 overpower the reversing gear cage biasing spring means 39, to bias toggle device 64 and reversing gear cage 18 to its opposite position to engage gear 34 and drive ring gear 50 in a counter-clockwise direction (see FIG. 3).

Figure 8:
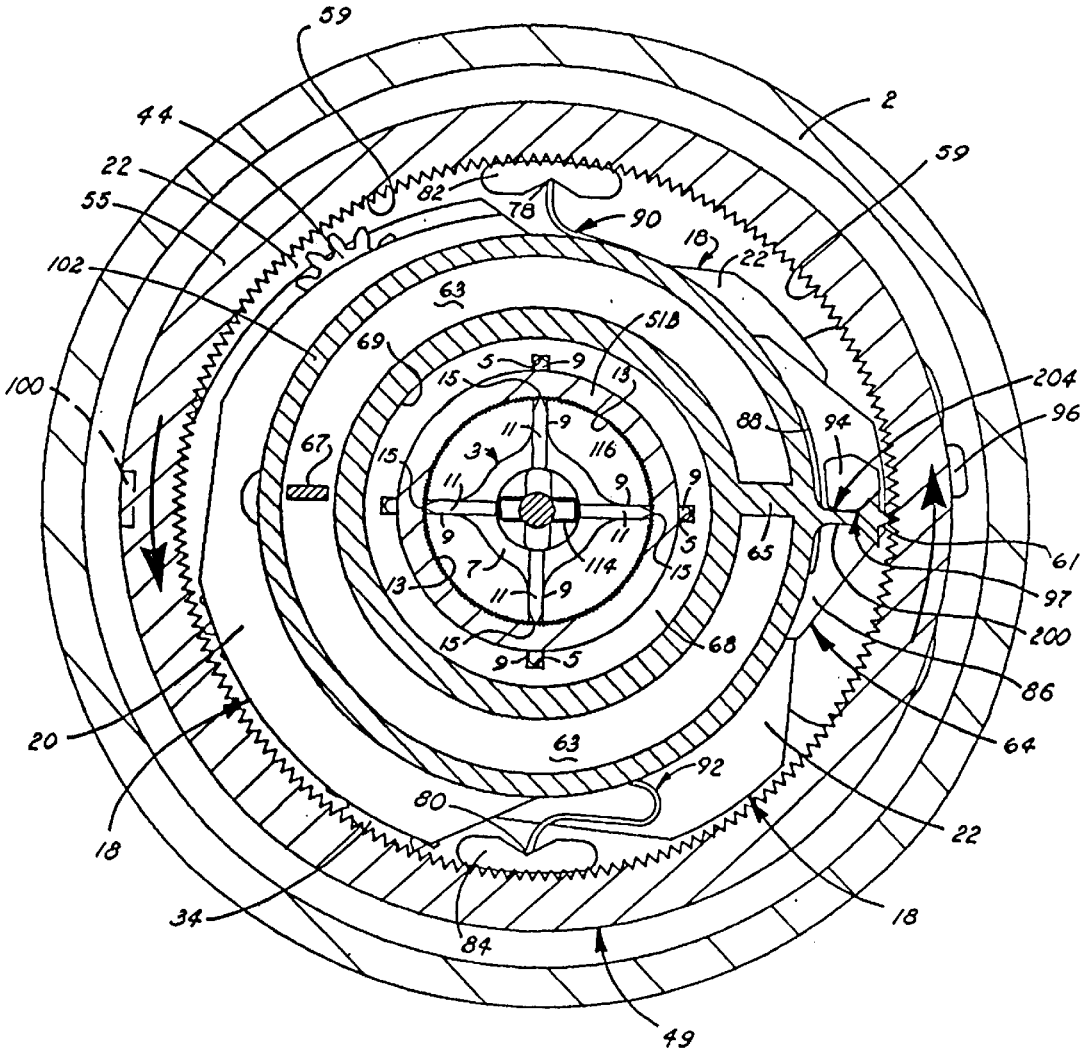
FIG. 8 is a transverse sectional view of the transmission device taken along the line 8—8 of FIG. 1 with the seal removed between the cooperating cylindrical member and output member, the position of the reversing gear cage and reversing toggle being the same as shown in FIG. 1 and FIG. 4.
Figure 10:
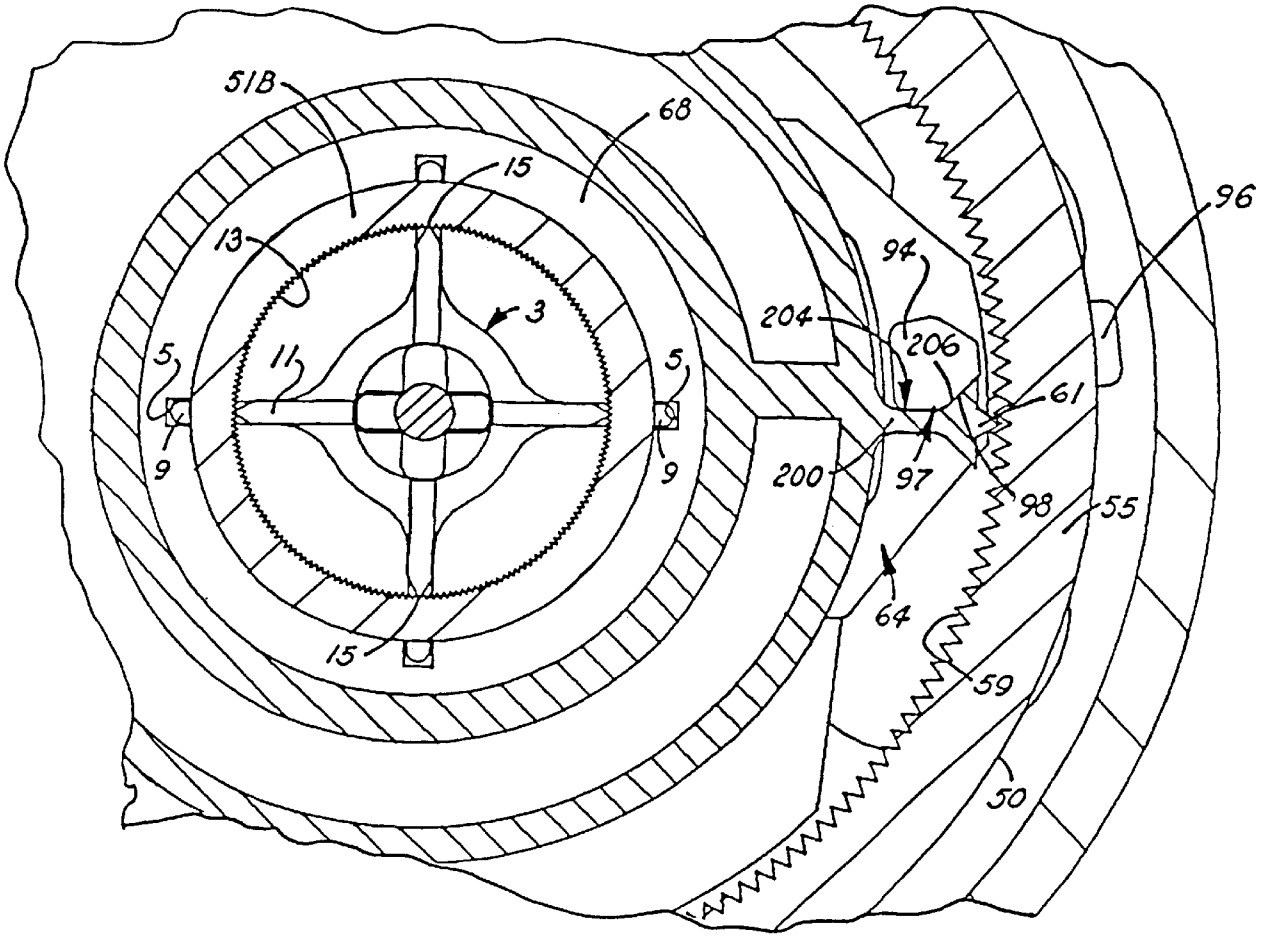
FIG. 10 is an enlarged view of the center part of FIG. 8, along with the angular adjustable radial projection, showing the connecting serrations.

An angularly adjustable radial projection 200 extends radially from an annular flange 102 on top of cylindrical member 68 to contact the upstanding projection 94 of toggle device 64 when ring gear 50 and annular flange 102 are being driven in a counter-clockwise direction by gear 34 of reversing gear cage 18 (see FIG. 3). This movement of upstanding projection 94, as described hereinbefore, moves toggle device 64 just over its centerline position and spring means 90 and 92 take over, as the driving engagement of gear 34 is broken and spring means 90 and 92 overpower the reversing gear cage biasing spring means 39, to bias toggle device 64 and reversing gear cage 18 to its opposite position to engage gear 44 and drive ring gear 50 in a clockwise direction (see FIG. 8 where adjustable radial projection 200 is about to move the upstanding projection 94 over its centerline position). The cooperation between ring gear 50 and annular flange 102 will be hereinafter described.

Output member 49 includes a cylindrical shaft member 51 with a radial flange 53 extending outwardly from a midportion thereof. A cylindrical flange 55 extends downwardly from the end of the radial flange 53, with output ring gear 50 being formed at the bottom thereof. Cylindrical shaft member 51 has an upper hollow output shaft portion 51A extending upwardly through opening 8 to the exterior of the cover 6 and a lower cooperating cylindrical portion 51B extending into cylindrical member 68.

The upper hollow output shaft portion, 51A forms an annular groove 104 with the top of cover 6. An annular resilient sealing member 106 is located in said groove 104. An output cap 108 is placed over the end of upper hollow output shaft portion 51A with its lower end enclosing the annular resilient sealing member 106. The output cap 108 is fixed to the upper hollow output shaft portion 51A by a pin 110. Other desired fixing means can be used.

The upper surface of radial flange 53 of output member 49 has a raised portion adjacent said upper hollow output shaft portion 51A on which a thrust washer 57 is placed to engage the inner surface of integral cover 6. The lower surface of radial flange 53 has a cooperating contour with the top surface of annular flange 102 on the top of cylindrical member 68 to limit the angular movement between the mating flanges 53 and 102.

An annular notch 69 is formed in the inner end of annular flange 102 facing the lower surface of radial flange 53 and upper part of cylindrical portion 51B. An annular resilient sealing member 71 is positioned in annular notch 69 to seal the gear housing from pressure in the annular passage through the central shaft area.

A slight rounded projection 73 extends from the top of top plate 20 of reversing gear cage 18 over integral shaft 25 to properly space it from the bottom of annular flange 102.

An annular groove 63 is placed in the top surface of annular flange 102, with an integral stop member 65 being placed therein. Said integral stop member 65 is positioned in said annular groove 63 a few degrees counter-clockwise of the adjustable radial projection 200 (see FIG. 8). A cooperating stop projection 67 extends downwardly from the lower surface of radial flange 53 and projects into the annular groove 63. It can be seen that flanges 102 and 53 have a relative angular movement of approximately 360 degrees, the arc of travel of stop projection 67 in annular groove 63 from one side of integral stop member 65 to the other.

A plurality of serrations 59 extend around the inner circumference of cylindrical flange 55 between the radial flange 53 of output member 49 and the internal teeth of ring gear 50. Serrations 59 are positioned to engage an angular holding pointer 61 on the adjacent end of angularly adjustable radial projection 200.

The lower part of cylindrical member 68 is formed having a smaller cylindrical section 68A, said smaller cylindrical section 68A forming an inner annular step 75 where it meets the upper larger portion of cylindrical member 68, and an outer rounded step 77. To receive the lower end of cylindrical member 68 and smaller cylindrical section 68A, base member 4 has a second opening 79 therethrough axially aligned with outlet opening 8. Second opening 79 has a small portion 81 of reduced diameter forming an annular step 83, and a small end portion 85 of a further reduced diameter which is threaded forming an annular step 87.

The upper part of cylindrical member 68 engages second opening 79 and smaller cylindrical section 68A engages the reduced diameter of portion 81 with the bottom end of smaller cylindrical section 68A engaging annular step 87. This forms an annular chamber between annular step 83 and outer rounded step 77. An annular resilient sealing member 89 is placed in said chamber against annular step 83, and a seal retaining ring 91 is placed between said sealing member 89 and the rounded step 77. This provides for proper positioning of cylindrical member 68 in cylindrical housing 2 and provides for sealing at that point. An adaptor 93 is threaded in opening 85 having an opening 95 therethrough for directing a liquid, such as water, into cylindrical section 68A, if desired.

An angular positioning member 3 interconnects the lower cooperating cylindrical portion 51B and cylindrical member 68 to set a desired angular position therebetween to control the oscillating angular movement of upper hollow output shaft portion 51A. Said lower cooperating cylindrical portion 51B extends into cylindrical member 68 approximately one-half of the distance to annular step 75. The inner surface of the upper portion of cylindrical member 68 has four equally spaced longitudinal turning grooves 5 extending from the annular notch 69 to the inner annular step 75. Angular positioning member 3 has a centerbody 7 with four equally spaced vane members 9 thereon. The lower portion of the vane members 9 extend into the cooperating grooves 5 from the bottom thereof up to approximately the lower end of lower cooperating cylindrical portion 51B. The vane members 9 are integrally attached to centerbody 7 up to this point. The vane members 9 then taper inwardly and extend upwardly as four individual projections 11 into the lower cooperating cylindrical portion 51B. This cylindrical portion 51B has serrations 13 therearound for engagement by tapered, or pointed, outer ends 15 on projections 11 to connect angular positioning member 3 to cylindrical portion 51B of output member 49.

Centerbody 7 of angular positioning member 3 has crossed slots 112 aligned with vane members 9 to receive the flat paddle 114 of an angular positioning or setting shaft 116. Angular positioning shaft 116 extends through output cap 108, presenting a small adjusting, or setting, slot 118 to the top of the output cap 108; said small slot having an indicating arrowhead at one end indicating the position of the angularly adjustable radial projection 200, while an indicating arrowhead on the output cap 108 indicates the position of the fixed projection 100. An annular flange 121 on angular positioning shaft 116 prevents the flat paddle 114 from becoming accidentally disconnected. A seal 124 extends between the output cap 108 and angular positioning shaft 116.

Gear teeth 120 are located around the output cap 108 to provide an external drive. An opening 122 is provided in output cap 108 to serve as a nozzle opening and it is aligned with the fixed projection 100. Angular degree settings can be inscribed in the top surface of the output cap 108 to set a desired oscillating angle.

In driving operation, input shaft 12 turns clockwise driving output ring gear 50 in an oscillating motion through a predetermined angle set by adjusting slot 118. This angle is shown as 180 degrees in the Figures. Starting from FIG. 3, drive gear 34 is engaged with and drives ring gear 50 counter-clockwise, bringing adjustable radial projection 200 into actuating contact with upstanding projection 94 of toggle device 64, moving toggle device 64 against spring means 90, 92 past an overcenter position reversing the action of spring means 90, 92. This biases toggle device 64 counter-clockwise for engagement with actuating post 60 of gear cage 18. Further movement of ring gear 50 by drive gear 34 continues to move radial projection 200 against upstanding projection 94 which begins to pivot the gear cage 18 against the force of spring means 39, disengaging the drive gear 34. The reversed action of spring means 90, 92 now overcomes the force of spring means 39, moving the spring means 39 past an overcenter position, reversing the action of spring means 39. Spring means 39 and spring means 90, 92 now carry gear cage 18 to its new clockwise driving position (see FIG. 5) with drive gear 44 engaging and driving ring gear 50 clockwise; movement of ring gear 50 clockwise bringing fixed projection 100 into actuating contact with radial projection 96 of toggle device 64, moving toggle device 64 against spring means 90, 92 past an overcenter position, reversing the action of spring means 90, 92. This biases toggle device 64 clockwise for engagement with actuating post 60 of gear cage 18. Further movement of ring gear 50 by drive gear 44 continues to move fixed projection 100 against radial projection 96 which begins to pivot the gear cage 18 against the force of spring means 39, disengaging drive gear 44. The reversed action of spring means 90, 92 now overcomes the force of spring means 39, moving the spring means 39 past the overcenter position, reversing the spring means 39. Spring means 39 and spring means 90, 92 now carry gear cage 18 back to its counter-clockwise position (see FIG. 3) with drive gear 34 engaging and driving ring gear 50 counter-clockwise. This oscillation continues as long as input shaft 12 is driven.

During the driving operation, fixed projection 100 is directly driven by ring gear 50 but angularly adjustable radial projection 200 is driven by ring gear 50 through serrations 59 and 13. Output member 49 has an equal number of serrations 59 and 13 above ring gear 50 and in cylindrical portion 51B, respectively. Angularly adjustable radial projection 200 has the angular holding pointer 61 on its outer end providing a direct driving connection with one serration of serrations 59, so ring gear 50 can drive the angularly adjustable radial projection 200. This angularly adjustable radial projection 200 has a special contour 204 on each side to mate with a contour 97 on upstanding projection 94. As contour 204 is driven against contour 97, the angular holding pointer 61 is held in its proper angle setting serration 59. This action is obtained by an angled surface 206 on the end of angularly adjustable radial projection 200 which extends outwardly in the direction of movement of the ring gear 50 to engage a mating angled surface 98 on upstanding projection 94. These angled surfaces 206 and 98 prevent the angular holding pointer 61 from bending in the direction the serrations 59 are moving and therefore preventing a serration 59 from being pulled over the angular holding pointer 61. This action is employed to self-lock the output cap to its last set position in both clockwise and counter-clockwise directions of movement of ring gear 50.

Angularly adjustable radial projection 200, extending from annular flange 102, has inner cylindrical member 68 providing an indirect driving connection with serrations 13 through which ring gear 50 can drive the annular flange 102 and angularly adjustable radial projection 200. Angular positioning member 3 interconnects lower cooperating cylindrical portion 51B to cylindrical member 68 through serrations 13 in lower cooperating cylindrical portion 51B and cooperating grooves 5 in cylindrical member 68. Tapered, or pointed, outer ends 15 on projections 11 extend into serrations 13 and the ends of vane members 9 extend into the cooperating grooves 5.

Rotation of lower cooperating cylindrical portion 51A turns serrations 13 which then rotate the ends 15 of projections 11 of angular positioning member 3; this rotates vane members 9 and cylindrical member 68 with its radial projection 200. Rotation of cylindrical member 68 through serrations 13 provides for slippage prevention. As lower cooperating cylindrical portion 51A rotates, or drives, angular positioning member 3, the ends of vane members 9 in grooves 5 are dragged slightly rearwardly by cylindrical member 68, placing a slight curve in the ends 15 of projections 11. The serrations 13 push, or bite, into the ends 15 and tend to have a fixed relationship, and prevent slippage and overriding. This arrangement also aids in maintaining the preset angular setting indicated on the output cap 108.

Figure 2:
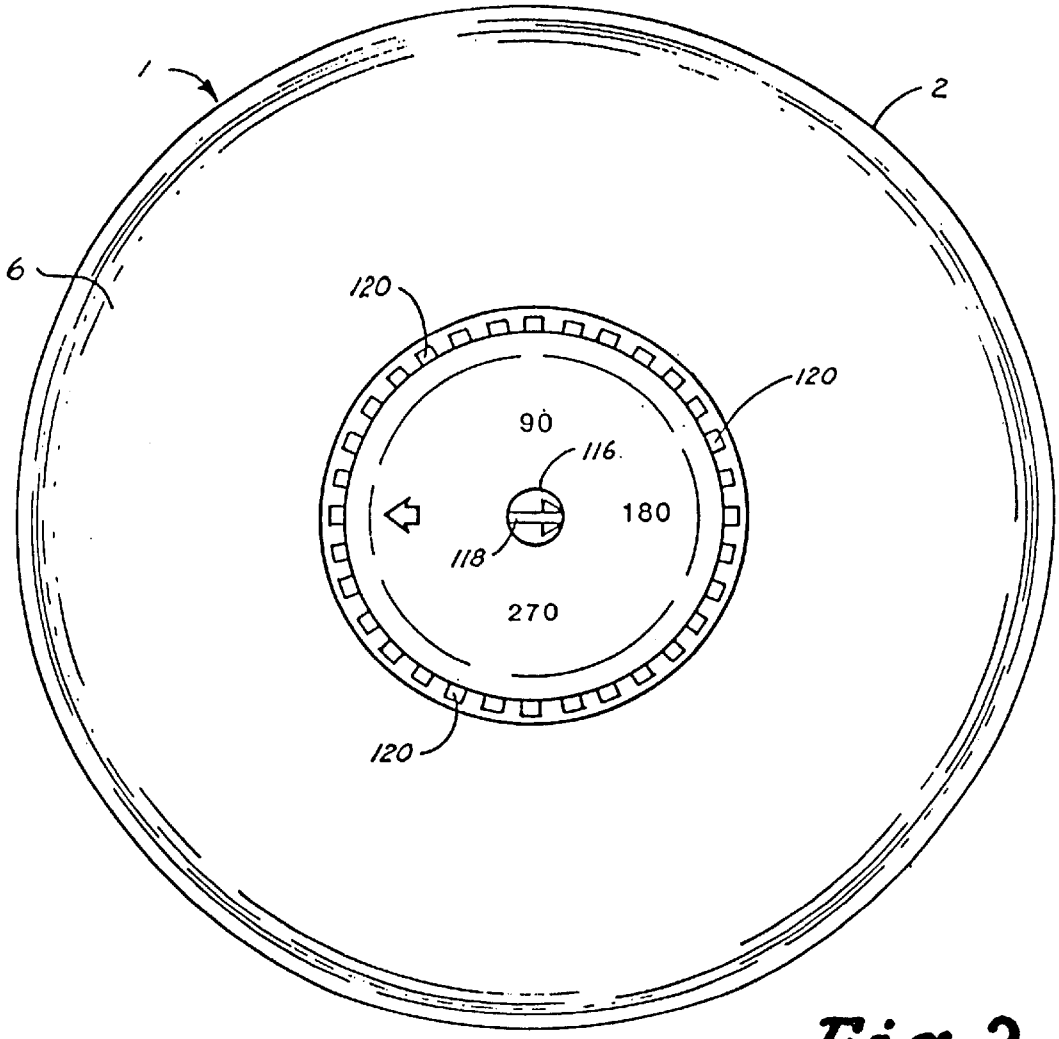
FIG. 2 is a top view of the transmission device of FIG. 1 showing the output cap and oscillating angle selector.

To set the angle between the fixed projection 100 and angularly adjustable radial projection 200, the adjusting slot 118 is observed to note the indicated angular setting. If the new desired angular setting is larger than the indicated setting, the output cap 108 can be held and the slot 118 moved clockwise to the larger desired oscillating angle. In all but one case, the angular setting can be made larger by merely holding the output cap 108 and pointing the arrowhead of slot 118 at the larger angle position. In this one case, the angle is set as described below for a smaller angular setting. In FIG. 2, if a setting of 270 degrees is desired, since it is set at 180 degrees, the arrowhead of slot 118 would merely be positioned to point at 270 degrees.

Movement of slot 118 rotates setting shaft 116 and flat paddle 114 clockwise. Flat paddle 114 rotates angular positioning member 3 and in turn cylindrical member 68 through vane members 9 and cooperating grooves 5. Tapered outer ends 15 on projections 11 are forced over the serrations 13, aided by bending of vane members 9 by the drag on the ends of vane members 9 in grooves 5, and angular holding pointer 61 on angularly adjustable radial projection 200 is forced over the serrations 59 to a new cooperating position with the serrations for the new angular setting.

If the new desired angular setting is smaller than the indicated setting, the output cap 108 is rotated clockwise as far as it will go with cooperating stop projection 67 engaging integral stop member 65, if it will rotate clockwise at all; if the output cap 108 cannot be rotated clockwise, it is rotated counter-clockwise as far as it will go, to actuate toggle member 64, and then rotated clockwise as far as it will go, as mentioned above. From this clockwise position the output cap 108 can be held and the slot 118 moved clockwise to the smaller desired oscillating angle.

Movement of slot 118 rotates shaft 116 and flat paddle 114 as before, to force the tapered outer ends 15 and angular holding pointer 61, over the serrations 13 and 59, respectively, to the new angular setting.

Figure 7:
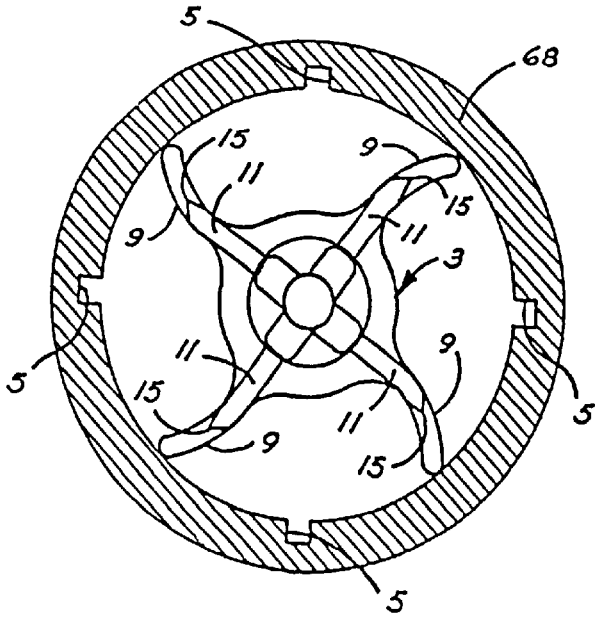
FIG. 7 is a view of the angular positioning member after its legs have become disengaged from grooves located in the cooperating cylindrical member.
Figure 9:
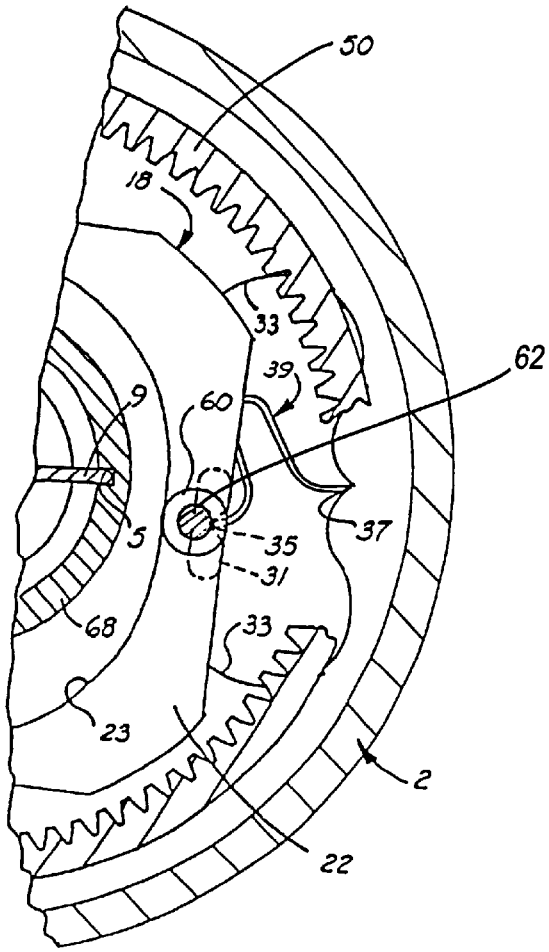
FIG. 9 is a fragmentary view of the right side of FIG. 3, with the toggle device removed and a portion of the ring gear broken away, to show the relation of the actuating post and downwardly projecting member of the reversing gear cage and gear cage overcenter spring means.

In the setting of the oscillating angle by turning the setting shaft 116, if the motion of cylindrical member 68 is restricted and the setting shaft 116 turned with excessive force, the vane members 9 will bend out of grooves 5, preventing any breakage by forcing setting shaft 116 (see FIG. 7). The material and thickness of the vanes 9 can be controlled to achieve a desired torque at which vanes 9 will be bent out of grooves 5 which will limit the torque placed on all other related operating parts.

The output cap 108 can have its oscillating motion connected to a device requiring an oscillating input by a gear meshing with gear teeth 120. Other drive means can be used, such as pullies.

If it is desired to use the transmission device 1 as an oscillating sprinkler head, a liquid such as water, can drive a turbine connected to input shaft 12 and then be directed into opening 95. From opening 95 the liquid will pass through the smaller cylindrical section 68A where it enters the larger part of cylindrical member 68 between the four spaced vane members 9. The liquid then flows past individual projections 11 around shaft 116 in the lower cooperating cylindrical portion 51B of cylindrical shaft member 51 into the upper hollow output shaft portion 51A and into the output cap 108. The liquid is directed outwardly from the output cap 108 through the oscillating nozzle opening 122.

Figure 11:
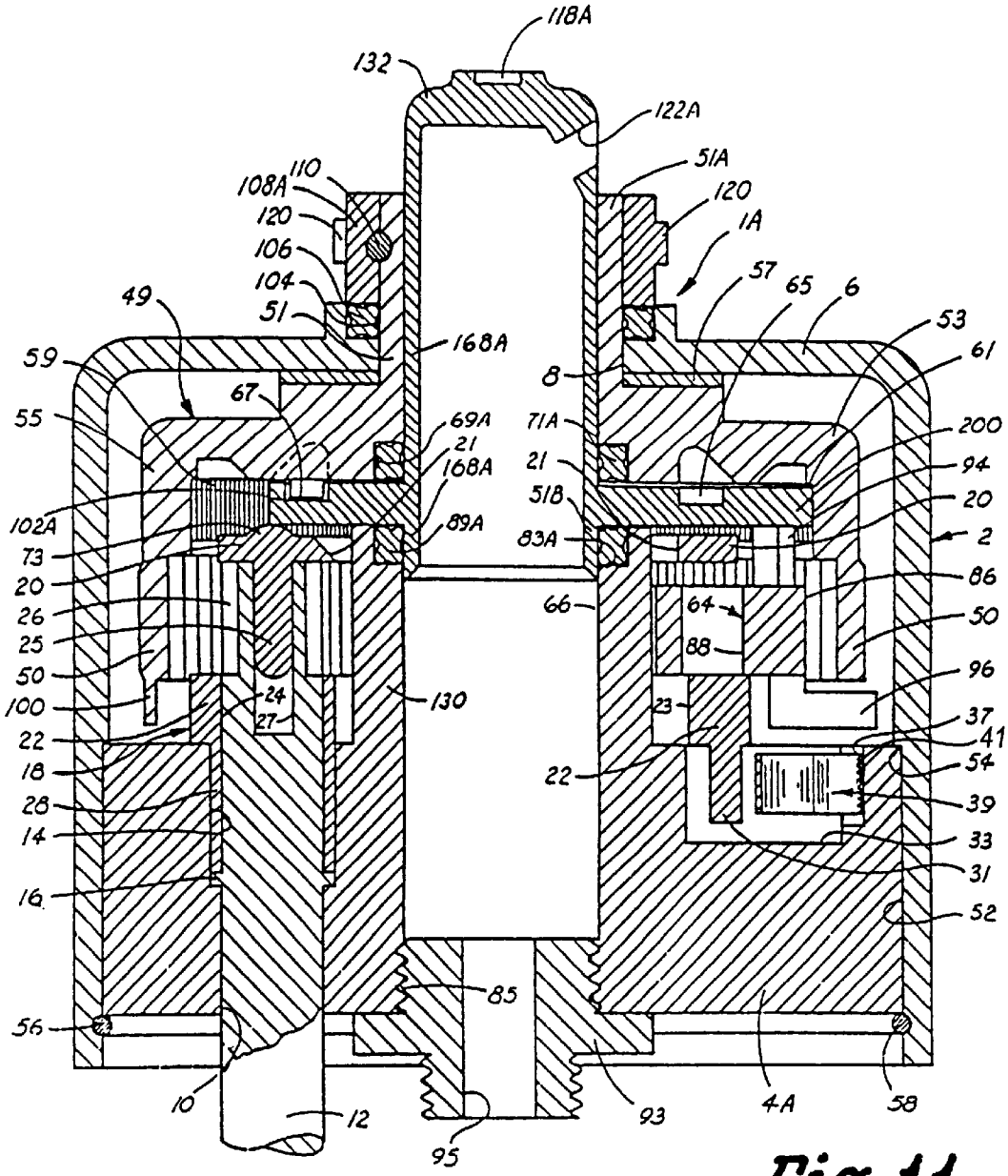
FIG. 11 is an elevational view in section of a modification of the transmission device as shown in FIG. 1.
Figure 12:
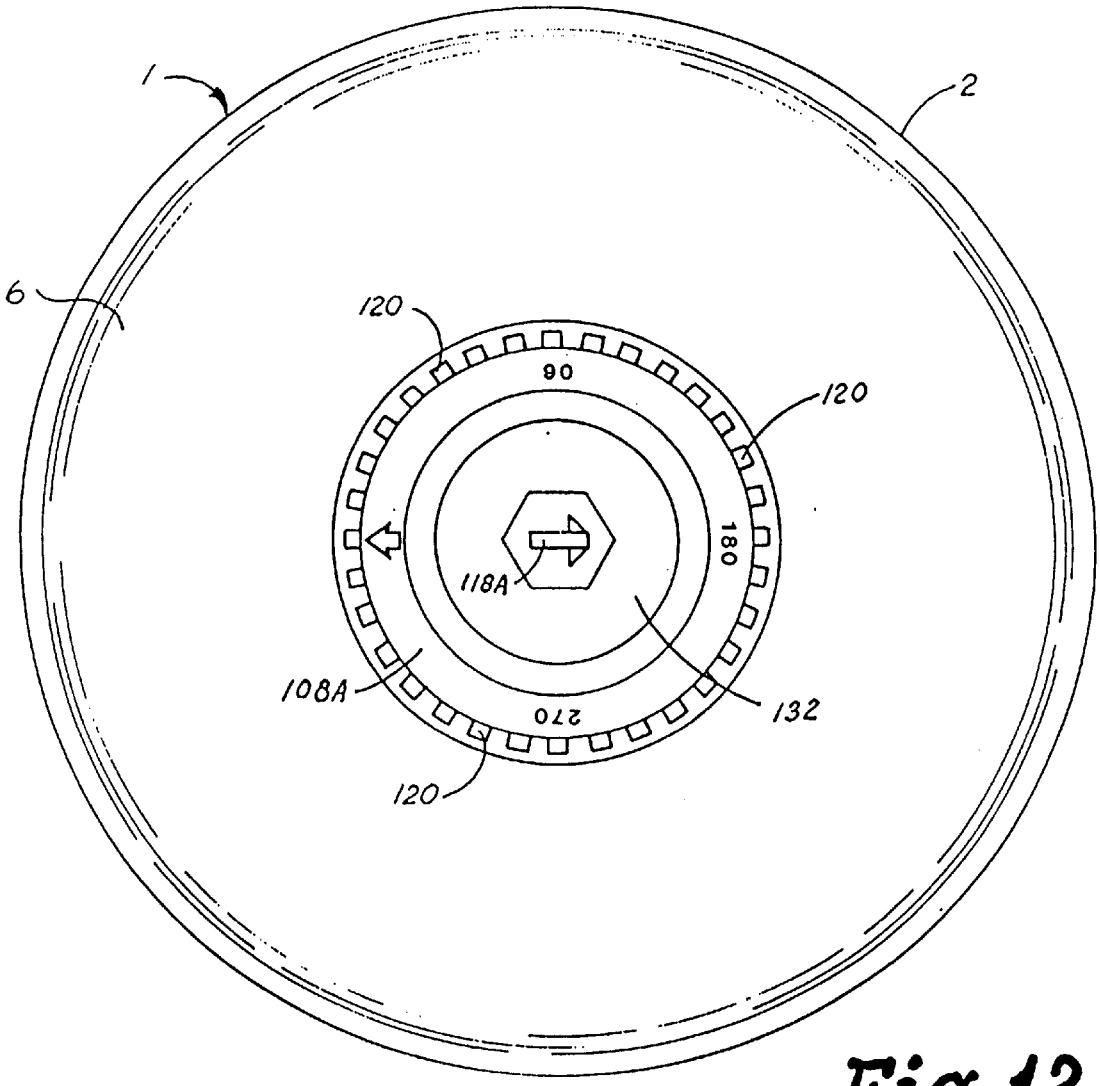
FIG. 12 is a top view of the modified transmission device of FIG. 11.

The modified transmission device 1A of FIG. 11 has the same rotary input shaft 12 and oscillating ring gear 50, with intermediate oscillating drive, as shown in FIG. 1 and described above, as can be seen from a comparison of the Figures. The basic difference is the simplification of the mechanism to set the desired oscillating angle between fixed projection 100 and adjustable radial projection 200.

In FIG. 11, the center upstanding cylindrical member 130 of base member 4A physically replaces the cylindrical member 68 and 68A and related annular seal ring 89 and seal retaining ring 91, for supporting and sealing remaining annular flange 102A. Removed along with cylindrical member 68 and 68A, are the angular positioning member 3, the lower cooperating cylindrical portion 51B, the angular positioning shaft 116, and the top of output cap 108 above the upper hollow output shaft portion 51A, leaving member 108A. The connection of pointer 61 of adjustable radial projection 200 to ring gear 50 remains the same.

Added to the modification is a cylindrical member 168A extending into hollow output shaft portion 51A and center cylindrical member 130 for connection to annular flange 102A to mount it for rotation in output ring gear 50 and provide for rotating the flange 102A and adjustable radial projection 200. The connection of adjustable radial projection 200 on flange 102A to ring gear 50 through pointer 61 and serrations 59 is as shown and described for FIG. 1. A top 132 can be placed on the cylindrical member 168A for placing a small adjusting, or setting, slot 118A thereon. If it is desired to use this modification as a sprinkler, the cylindrical member 168A can extend externally of the upper hollow output shaft portion 51A, and have a nozzle opening 122A placed in the side thereof.

An annular groove 83A is placed in the top of center cylindrical member 130 around cylindrical member 168A for receiving a seal 89A, and an annular groove 69A is placed in the output member 49 around cylindrical member 168A for receiving a seal 71A.

It can be seen that this modification provides a simple mounting and setting arrangement for flange 102A and adjustable radial projection 200. To indicate the angular setting of the transmission, an indicating arrowhead is placed on the edge of member 108A indicating the position of fixed projection 100, while an arrowhead is placed on one end of slot 118A indicating the position of angularly adjustable radial projection 200.

The driving operation of this modification is the same as that of FIG. 1, with the angular setting of angularly adjustable radial projection 200 being made simpler, especially with the removal of the angular positioning member 3 and lower cooperating cylindrical portion 51B, which did away with the serrations 13 and cooperating tapered ends 15 on projections 11. Cylindrical member 168A provides the setting function of setting shaft 116 of FIG. 1.

Figure 6:
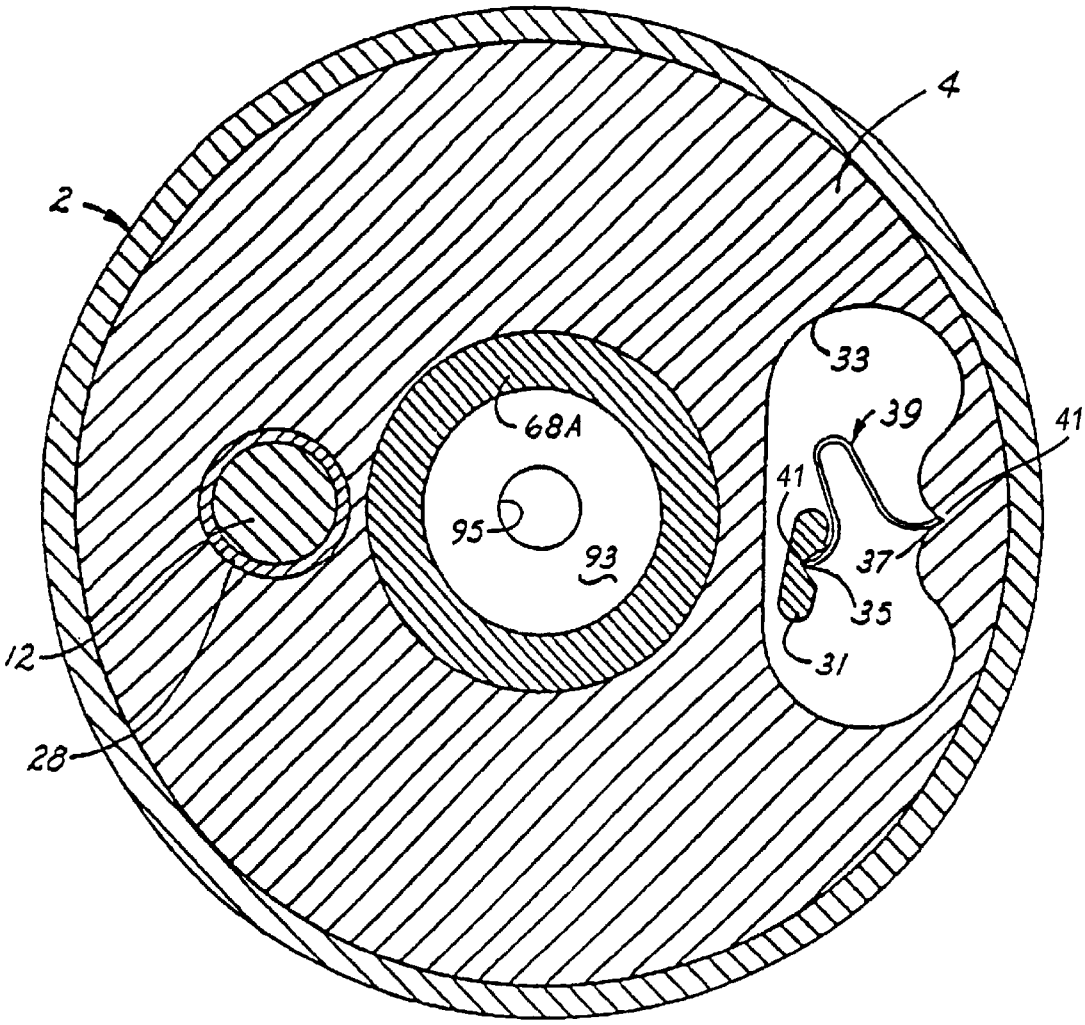
FIG. 6 is a transverse sectional view of the transmission device taken along the line 6—6 of FIG. 1 showing the overcenter spring means for the reversing gear cage.
Figure 13:
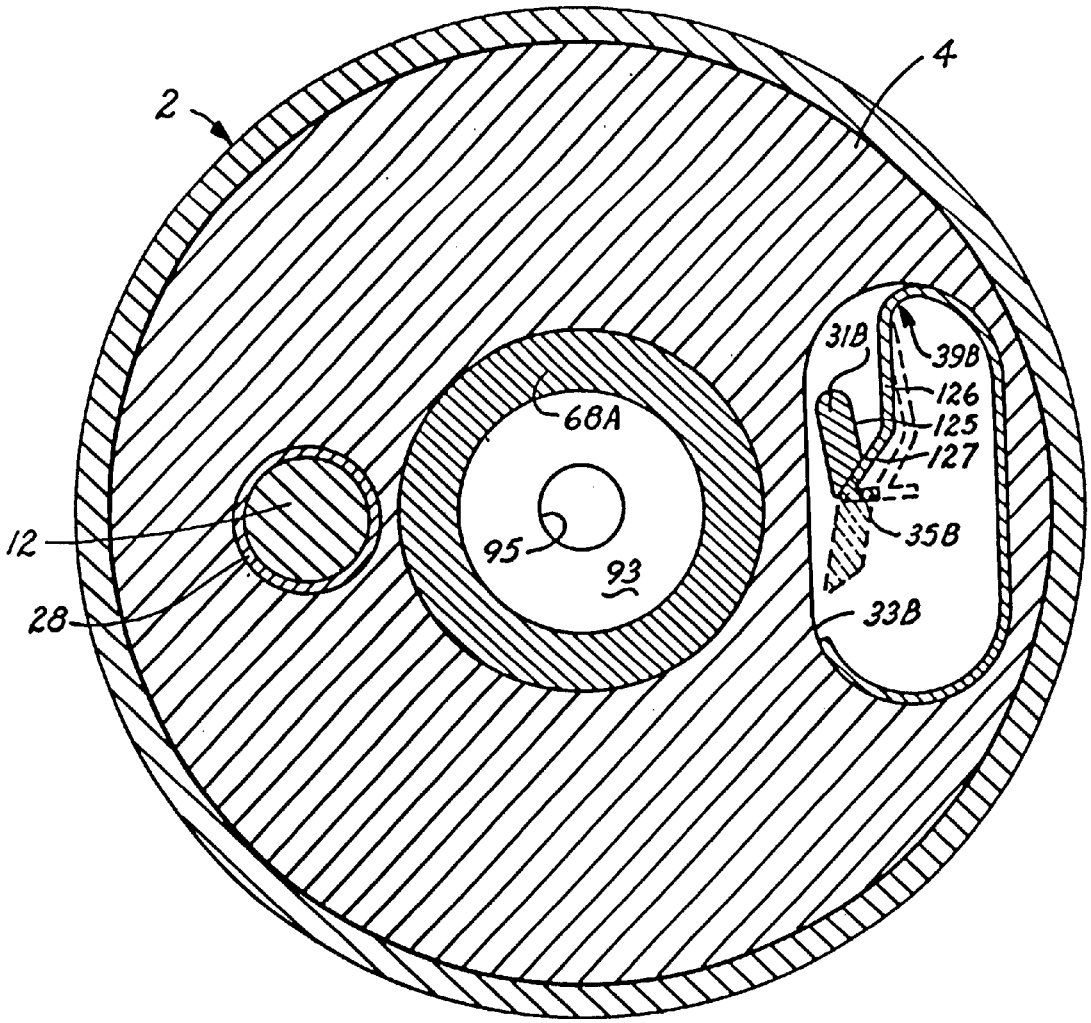
FIG. 13 is a view similar to FIG. 6 showing a modification of the spring means where the gear cage is only directly biased in one direction.

As seen in FIG. 13, to provide for biasing of the gear cage 18 in only one direction, the recess 33B is formed similar to recess 33 of FIG. 6, with spring seat notch 37 removed and the outer wall made straight. A spring member 39B extends around a curved end of recess 33B along the straight outer side and around approximately one-half of the other curved end where it extends into the recess 33B with a straight portion 126 and a portion 127 angled towards the center of the straight inner side of the recess 33B for engaging downwardly projecting member 31B.

In this modification, the downwardly projecting member 31B of the bottom plate 22 of the reversing gear cage 18, is formed as approximately a one-half portion of the projecting member 31 of FIG. 6. The downwardly projecting member 31B has a flat surface 125 perpendicular to a line through the center of input shaft 12, and an angled surface 35B. When the portion 127 rests on the flat surface 125, no biasing force is placed on the gear cage 18 (as shown in phantom in FIG. 13). A biasing force is only placed on the gear cage 18 in one direction when portion 127 contacts the angled surface 35B.

This requirement is to only move the reversing gear cage 18 in one direction back into engagement after the output shaft 51 has manually been turned clockwise externally forcing the teeth of driving gear 44 out of engagement and removing the biasing force through the toggle device 64. This requirement is for a very small angle of gear cage 18 movement clockwise. Other positions of the gear cage 18, outside of the small angle referred to, permit a gear, 34 or 44, of the gear cage 18 to engage the ring gear 50, by biased toggle device 64 or by torque applied by the spur gear 26 to the gear cage 18. Those gear cage 18 locations are between a first position where radial projection 96 has been moved by fixed projection 100 to remove gear 44 from engaging ring gear 50 while removing the biasing toggle force, and a second position where the end of arcuate opening 88 first permits driving gear 34 to engage ring gear 50 for a driving action.

The cam action biasing configuration of FIG. 13 is attractive since it can be designed to be exactly responsive to the small angular biasing requirement with biasing removed when not needed. The bias is applied only during the movement range of 31B that surface 127 is engaging surface 35B.

Another advantage is that the biasing force of this configuration can be designed to remain relatively constant over the movement range that bias is applied. This configuration could, of course, be designed to also provide for bias in the other direction if needed, by putting an angled surface 35B on the other end of downwardly projecting member 31B. The arc through which the bias operates can be predetermined by the length of the angled surface 35B.

Figure 14:
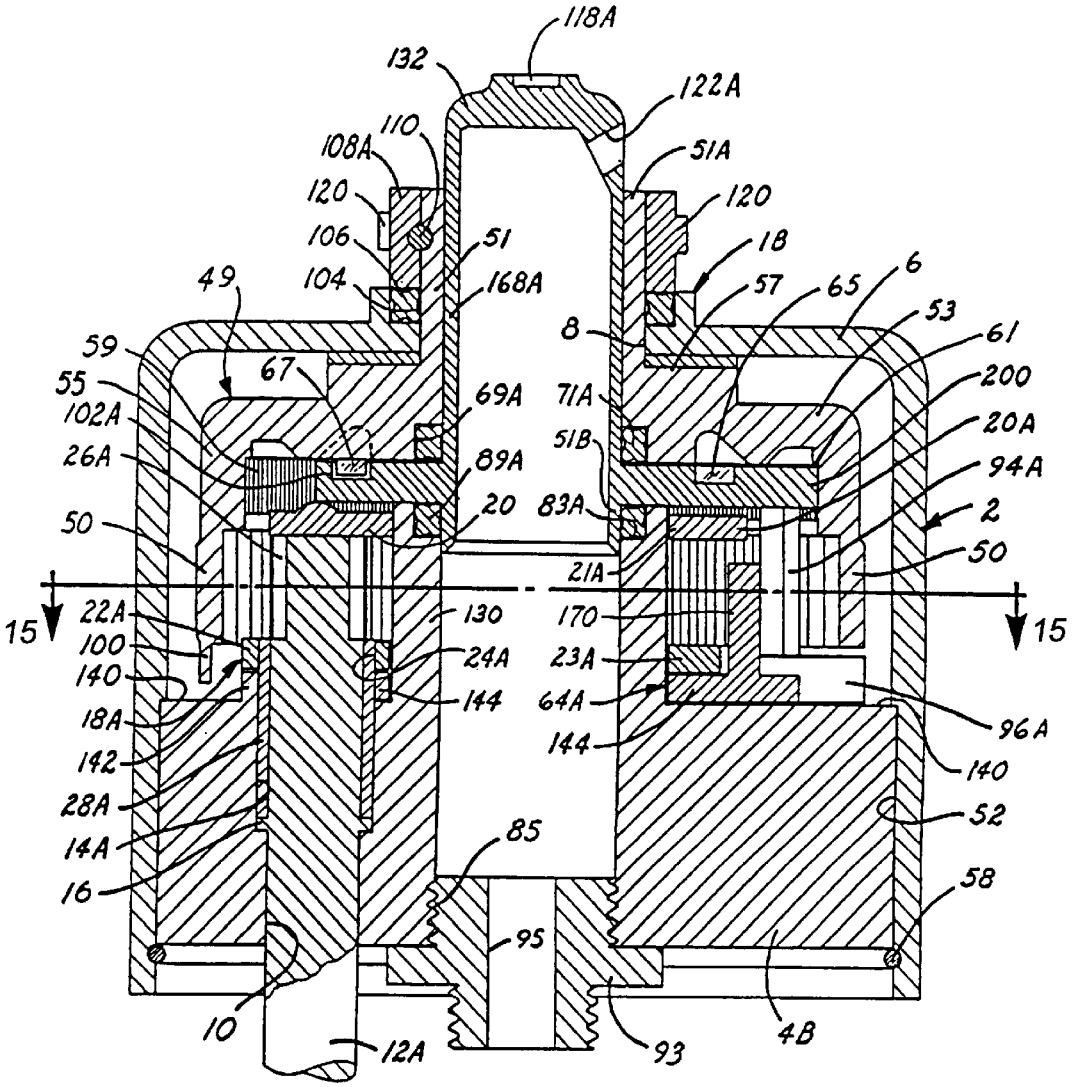
FIG. 14 is an elevational view in section of another modification of the transmission device as shown in FIGS. 1 and 11.

The transmission device 1B of FIG. 14 is a modification of the transmission device 1A of FIG. 11. The drive means between the input shaft 12 and ring gear 50 is changed by (1) replacing the gear cage 18 with a new gear cage 18A; (2) replacing the toggle device 64 with a new toggle device 64A; (3) removing the spring means 39 and cooperating parts, downwardly projecting member 31 and recess 33, for previously maintaining a direct biasing force on gear cage 18 at all times, and (4) placing a bearing sleeve 28A around the top of input shaft 12A.

The base member 4B has the recess 33 removed and presents a flat surface 140 around center upstanding cylindrical member 130, for the toggle member 64A to be located on for oscillating movement around center cylindrical member 130. A raised pad 142 on flat surface 140 is arcuate in shape and is positioned to provide a stop surface at either end, equally spaced from the center of spur gear 26A and rotary input shaft 12A, for toggle device 64A, for a purpose to be hereinafter described. A bearing sleeve 28A is press fitted into enlarged part 14A of opening 10 over annular flange 16 and projects above the raised pad 142 and flat base plate 144 of toggle device 64A to the bottom of the spur gear 26A to provide a stop surface on two sides for gear cage 18A for a purpose to be hereinafter described.

Toggle device 64A comprises the base plate 144 which is substantially circular in shape having an outer cut-out portion 146 to encompass raised pad 142, having cooperating end stop surfaces to have contact with the ends of raised pad 142 to provide a limiting movement between the reversing toggle device 64A and the base member 4B for operation and assembly. Base plate 144 has two opposed inner cut-out portions 148 and 150, opening to the outer surface of cylindrical member 130. The outer surface of cylindrical member 130 has diametrically opposed spring seat notches 152 and 154; spring seat notch 152 faces cut-out portion 148 and spring seat notch 154 faces cut-out portion 150. The outer portion of cut-out portion 148 has a spring seat 156 and the outer portion of cut-out portion 150 has a spring seat 158, said spring seats 156 and 158 being diametrically opposed and spaced equidistant from spring seats 152 and 154, respectively.

Figure 15:
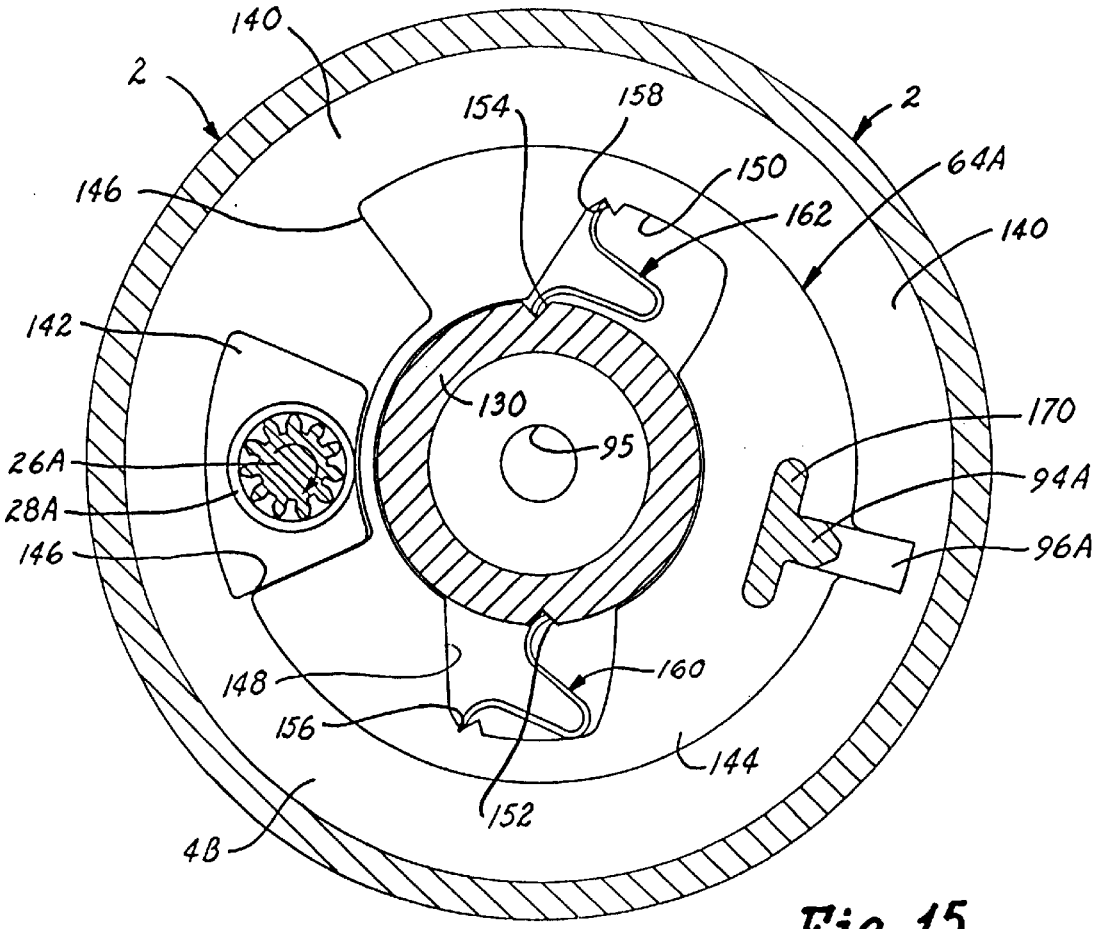
FIG. 15 is a transverse sectional view of the transmission device taken along a plane represented by line 15—15 of FIG. 14 with the ring gear and reversing gear cage removed, showing the reversing toggle device.

An overcenter spring means 160 extends between spring seat notch 156 on reversing toggle device 64A and spring seat notch 152 on base cylindrical member 130, and a cooperating overcenter spring means 162 extends between spring seat notch 158 on reversing toggle device 64A and spring seat notch 154 on base cylindrical member 130. Spring means 160 and 162 bias reversing toggle device 64A in a clockwise direction as viewed in FIGS. 15 and 16, and in a counter-clockwise direction as viewed in FIG. 18. The action of these spring means 160 and 162 reverses when seat notches 156 and 158 pass on either side of a centerline passing through the spring seat notches 152 and 154.

The base plate 144 has an upstanding projection 94A for rotating said toggle device 64A in a counter-clockwise direction when contacted by the angularly adjustable radial projection 200, and an outwardly extending radial projection 96A for rotating said toggle device 64A in a clockwise direction when contacted by the fixed projection 100. Another projection 170 extends upwardly from plate 144, radially inward of projection 94A and attached thereto, for a purpose to be hereinafter described. Gear cage 18A is formed having a top plate 20A and a bottom plate 22A with cooperating concentric center openings 21A and 23A, respectively, for placing over base cylindrical member 130. Bottom plate 22A rests on the base plate 144 of toggle device 64A. The bottom plate 22A has an elongated opening 24A to receive the rotary input shaft 12A and bearing sleeve 28A, to provide a limiting movement between the gear cage 18A and the base member 4B for operation; this limiting movement being determined by the length of the elongated opening 24A. This distance could limit the travel of the gear teeth of gear 34A or 42A towards engagement with the gear teeth of spur gear 26A. Spur gear 26A extends upwardly from the top of bottom plate 22A to the top plate 20A.

Figure 16:
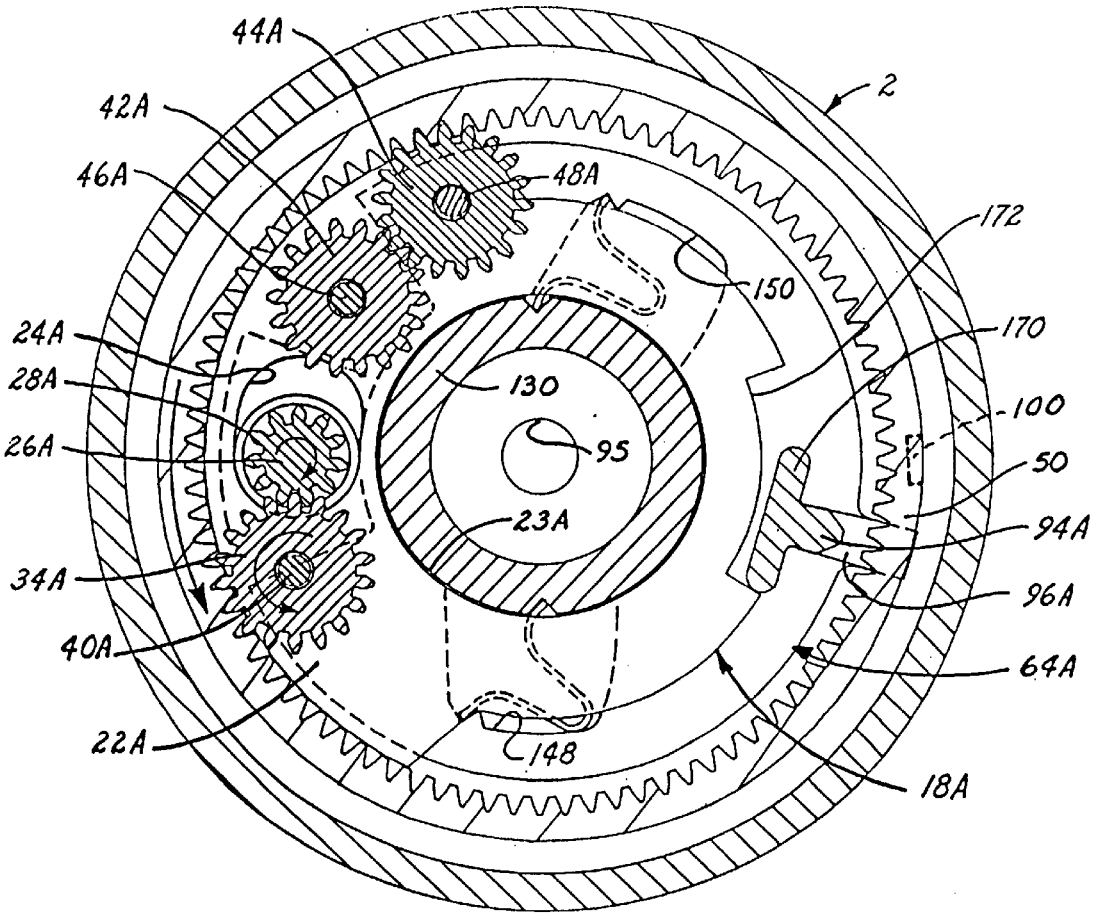
FIG. 16 is a transverse sectional view of the transmission device taken along a plane represented by line B—B of FIG. 14 showing the reversing gear cage and reversing toggle, each biased clockwise with a driving gear engaging the spur gear on the input shaft for driving the ring gear counter-clockwise.
Figure 17:
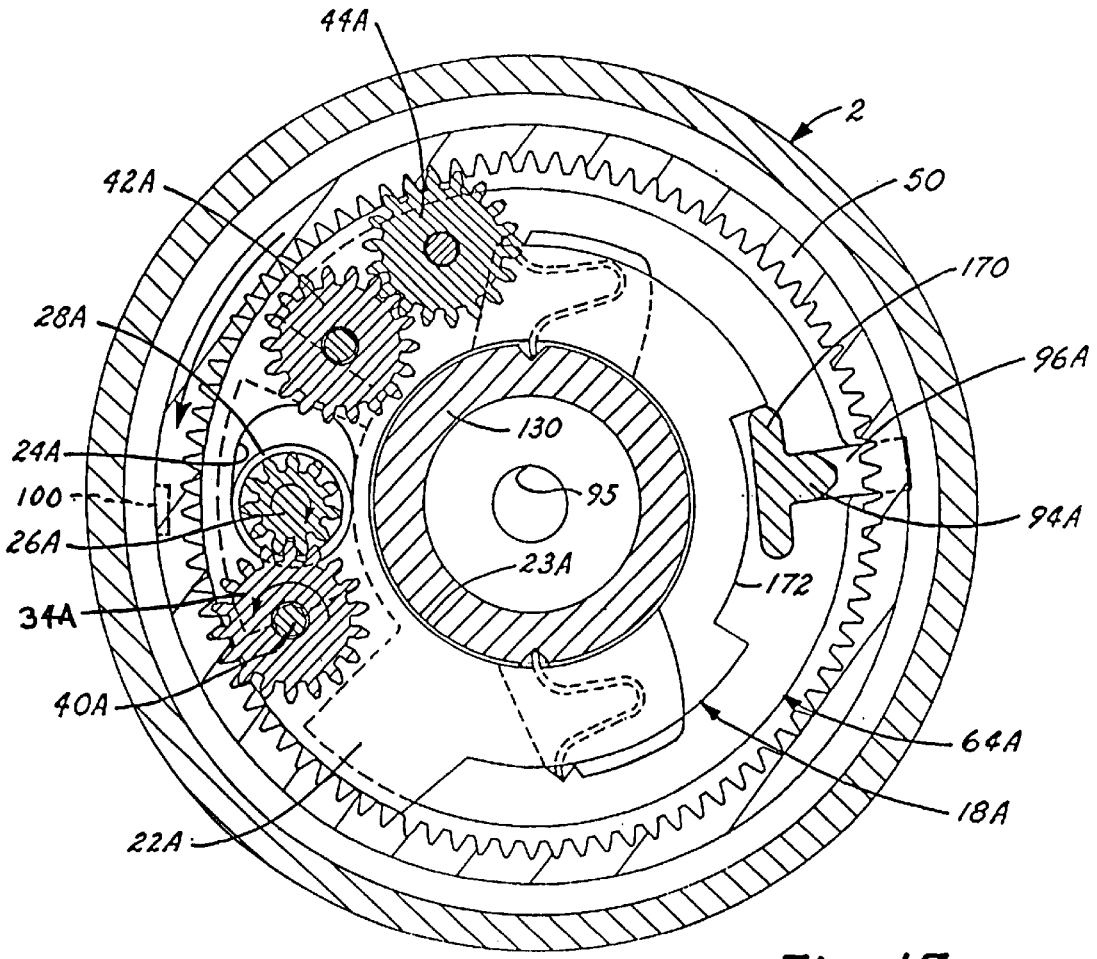
FIG.17 is a transverse sectional view of the transmission device taken along a plane represented by the line 15—15 of FIG. 14 showing the reversing toggle forced counter-clockwise to a position where the reversing toggle has just passed over a center line reversing the biasing forces on said reversing toggle.
Figure 18:
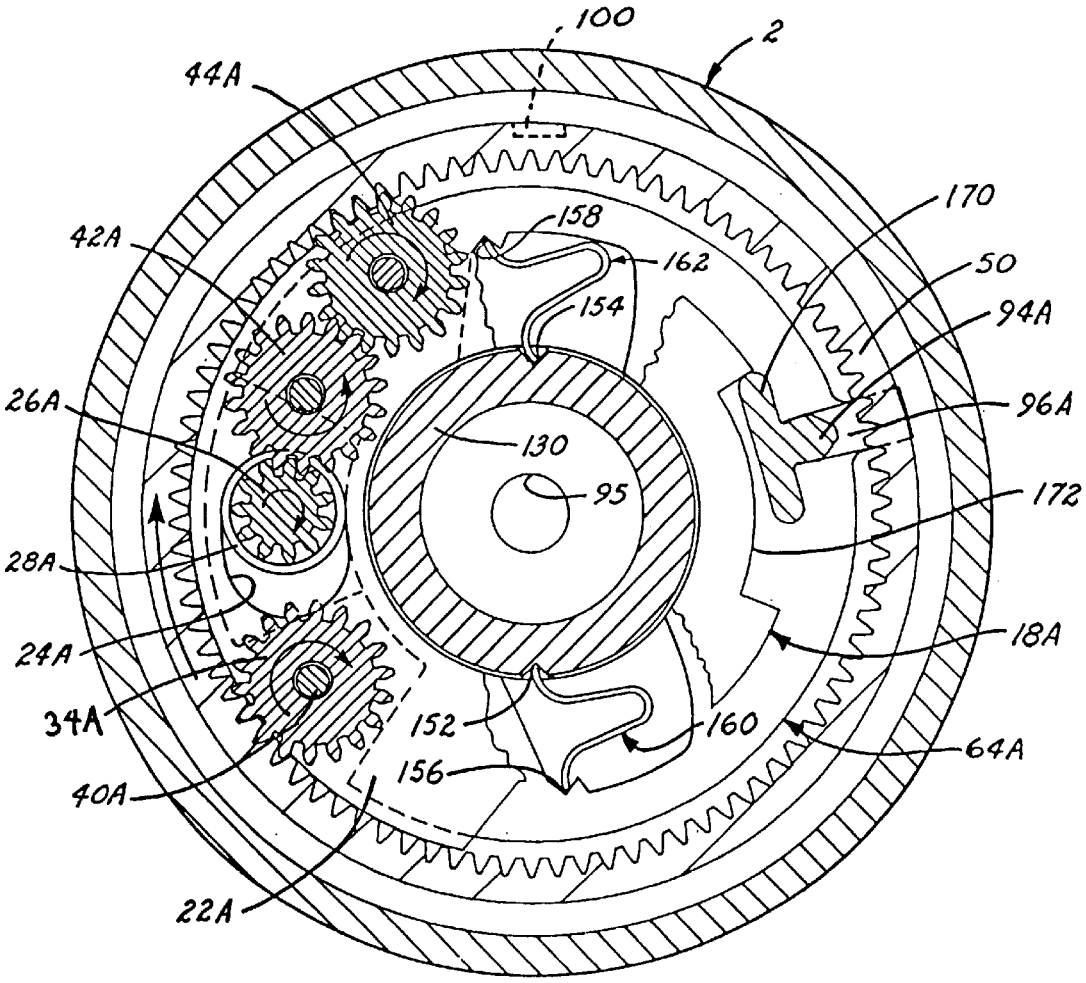
FIG. 18 is a transverse sectional view of the transmission device taken along a plane represented by the line 15—15 of FIG. 14 showing the reversing gear cage and reversing toggle, each biased counter-clockwise with the other driving gear having its idler gear engaging the spur gear on the input shaft for driving the ring gear clockwise; the gear cage is cut away to show the spring means.

As shown in FIGS. 16, 17, and 18, one gear 34A is mounted on an integral shaft 40A extending downwardly from top plate 20A of reversing gear cage 18A and it is in a counter-clockwise direction from the spur gear 26A. Gear 34A is mounted to extend over the edges of top plate 20A and bottom plate 22A so that it engages output ring gear 50.

Two gears 42A and 44A are mounted on integral shafts 46A and 48A extending downwardly from top plate 20A of the reversing gear cage 18A and they extend in a clockwise direction from the spur gear 26A. Gear 42A is an idler gear and is spaced from gear 34A to permit alternate engagement with spur gear 26A therebetween. Gear 44A is mounted to extend over the edges of top plate 20A and bottom plate 22A so that it engages output ring gear 50. Integral shafts 40A, 46A, and 48A of top plate 20A extend into matched openings in bottom plate 22A and have a snap engagement at their ends.

To provide for the "lost motion" connection of toggle device 64A with respect to rotation of gear cage 18A, an arcuate cut-out 172 is placed on bottom plate 22A to encompass projection 170; the ends of cut-out 172 providing the limits of rotative movement of projection 170, and therefore, relative movement of toggle device 64A with gear cage 18A. Actuating post 60 and arcuate opening 88 provide this "lost motion" connection in the transmission device 1 of FIG. 1, and transmission device 1A of FIG. 11.

In driving operation, input shaft 12A turns clockwise driving output ring gear 50 in an oscillating motion through a predetermined angle set by adjusting slot 118A. This angle is shown as 180 degrees in the Figures. Starting from FIG. 16, drive gear 34A engages spur gear 26A of shaft 12A and drives ring gear 50 counter-clockwise, bringing adjustable radial projection 200 into actuating contact with upstanding projection 94A of toggle device 64A, moving toggle device 64A against spring means 160, 162 past an overcenter position reversing the action of spring means 160, 162. This biases toggle device 64A counter-clockwise for engagement of projection 170 with an end of cut-out 172 of gear cage 18A. Further movement of ring gear 50 by drive gear 34A continues to move radial projection 200 against upstanding projection 94A which begins to pivot the gear cage 18A for disengaging the drive gear 34A. The reversed action of spring means 160, 162 then carries gear cage 18A to its new clockwise driving position (see FIG. 18) where idler gear 42A engages spur gear 26A of shaft 12A which drives drive gear 44A, driving ring gear 50 clockwise; movement of ring gear 50 clockwise bringing fixed projection 100 into actuating contact with radial projection 96A of toggle device 64A, moving toggle device 64A against spring means 160, 162 past an overcenter position, reversing the action of spring means 160, 162. This biases toggle device 64A clockwise for engagement of projection 170 with an end of cut-out 172 of gear cage 18A. Further movement of ring gear 50 by drive gear 44A continues to move fixed projection 100 against radial projection 96A which begins to pivot the gear cage 18A for disengaging drive gear 44A. The reversed action of spring means 160, 162 then carries gear cage 18A back to its counter-clockwise position (see FIG. 16) with drive gear 34A engaging spur gear 26A and driving ring gear 50 counter-clockwise. This oscillation continues as long as input shaft 12A is driven.

Figure 19:
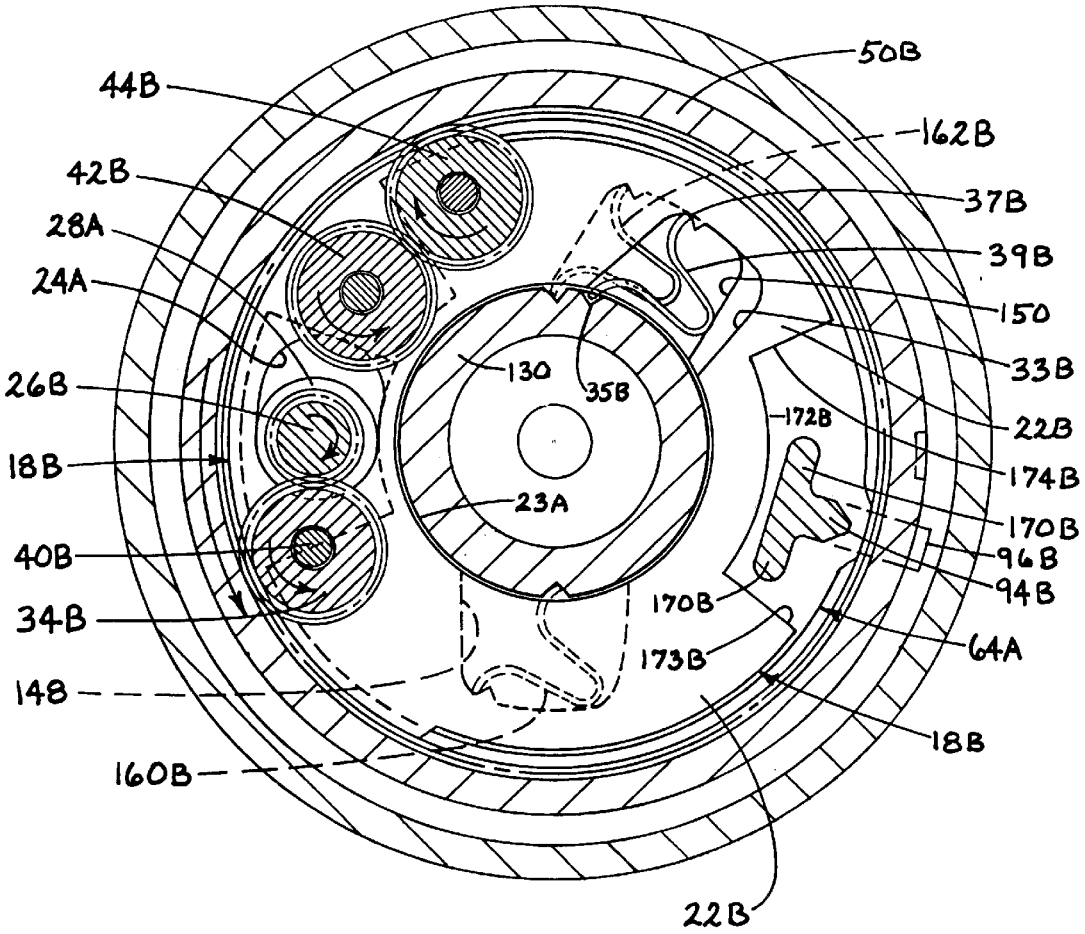
FIG. 19 is a transverse sectional view of another modification of the transmission devices shown in FIGS. 1–18 where a gear cage bias spring has been added to the reversing transmission described in detail for FIGS. 14 thru 18 where the driving pinions are continuously engaging the output gear.

FIG. 19 shows a modification of the configuration shown in FIG. 16 to include a separate reversing gear cage biasing spring 39C.

The shiftable gear cage of FIGS. 1–13 will not stay engaged reliably with the transmission output drive shaft ring gear without the help of the gear cage terminal driving gears having at least some biting engagement relationship with the output ring gear when engaged on the side where the driving torque of the input shaft 12 wants to rotate the gear cage 18 out of driving engagement. As shown in FIGS. 1 through 5 the input shaft 12 is rotating clockwise, and frictional and driving torque on gear cage 18 pinion gears 30, 32, 34, 44 and 46 want to cause the gear cage 18 to be rotated clockwise as previously discussed, and move it out of driving engagement of driving terminal gear 46 with output ring gear 50 unless the gear cage is biased into engagement by shifting toggle device 64 or a separate second gear cage bias that is maintained up until the gear cage is shifted. Previous sprinkler reversing gear cages relied on the teeth of the gear cage terminal gear wanting to bite into the teeth of the output ring gear 50 to maintain driving engagement when the reversing toggle bias was removed.

With the shifting gear cage arrangement of FIGS. 14–19, there is no rotational input shaft torque applied to the gear cage 18A or 18B. This allows using much finer teeth for the shiftable gearing and smaller annular rotation of the gear cage and shifting mechanism.

In FIG. 19 the lower gear cage plate 22B has been modified to include an inner cut out portion 33B opening to the outer surface of cylindrical member 130 of base member 4. Another spring seat notch 35B has been added to cylindrical member 130 within the area of inner cut out portion 33B of the lower gear cage plate 22B.

The outer portion of cut out portion 33B of lower gear cage 22B also has a cooperating spring seat notch 37B. An overcenter gear cage bias spring 39B extends between spring seat notch 35B on the cylindrical member 130 and spring seat notch 37B on lower plate 22B of the gear cage 18B. Spring 39B now biases the gear cage 18B of this configuration in a clockwise or counter-clockwise driving position until positively shifted by the action of the overcenter toggle shifting arm 64B as previously discussed for the reversing configuration of FIGS. 14 through 18.

The gear cage bias incorporated in this manner provides the same advantage for this gear cage as desired and previously described for the toggle device of FIGS. 1 through 14 and an objective of this invention. The fact that the inner end of the biasing spring 39B is fixed and the outer end acts at a greater radius on the gear cage, provides more torque to move the gear cage as was explained for the overcenter shifting toggle device 64A of the configurations of FIGS. 14 through 18.

As previously explained for the camming surface gear cage biasing spring discussions, once the engaging bias of the reversing toggle device 64 has been removed and not carried over center to be reapplied, if there is no secondary engaging biasing force on the gear cage 18, rotation of the nozzle and output shaft 51 rotates the output gear carrying the driving pinion 34 or 44 of the gear cage out of driving engagement and the drive will not start itself again if left in a neutral position.

The primary reason to have the gear cage bias for this configuration is to allow the sprinkler nozzle to be manually rotated back and forth during installation and arc of oscillation adjustment to verify the ground coverage of the oscillation of the sprinkler. This would be especially true for sprinklers that did not incorporate the feature disclosed in the patent application Ser. No. 932,470, filed Nov. 18, 1986 now U.S. Pat. No. 5,417,370, which is incorporated herein by reference, where the arc of oscillation set is indicated on the top of the sprinkler. As the sprinkler nozzle is manually rotated back and forth the gear cage biasing spring keeps the gear cage driving pinion gear 34C from being carried overcenter and prematurely engaging the other input shaft spur gear 27C stopping the manual rotation of the nozzle turret before it correctly indicates the operating arc of sprinkler coverage which it is needed to know when the sprinkler is being installed.

Another benefit of the gear cage bias spring is that it can carry the gear cage further overcenter into engagement and allow the rotational travel of the shifting arm toggling device to be less than might be required if it were also required to bias the gear cage all the way into full driving engagement of the gearing. The toggle device now functions only as an overcenter carry mechanism for the gear cage bias once the gear cage has been driven out of driving engagement. This additional engagement travel is illustrated in FIG. 19. It can be seen that the added gear cage bias spring has carried the gear cage further clockwise opening a gap between the notch 172B end 173B and the toggle 64A projection 170B.

The widened cut-out opening 172B which provides the lost motion connection between the shifting toggle device 64B and the gear cage 18B then allows the toggle to be further overcenter in the shifting direction for greater overcenter rotational torque by the toggle device 64B produced by its overcenter bias springs 160B and 162B before it again engages the other end 174B of cutout opening 172B to drive the gear cage out of driving engagement counter-clockwise and then over power the remaining bias of the gear cage bias spring 39B to carry it overcenter and achieve the reversing action.

The gear cage 18B is shown being biased fully clockwise with its driving terminal gear 34B engaging input shaft 26B and output shaft ring gear 50B for driving the output shaft in a counter-clockwise direction.

The gear cage 18B biasing spring 39B exerts an engaging bias clockwise as shown against spring notch 37B on the inside surface of cut-out 33B which has been added to the now enlarged gear cage lower plate 22B diameter in this area. The other end of spring 39B is secured in an additional notch 35B in the outside surface of cylindrical member 130.

The pitch diameter of the gear teeth has been increased to have a larger number of smaller teeth in the driving terminal gears and input shaft spur gear and output shaft ring gear.

Gears are shown without teeth in some Figures, showing only the pitch circles and outside diameters for illustration of each of the gears.

The smaller gear teeth allow shifting from driving engagement in a clockwise direction through neutral to a driving direction counter-clockwise to be accomplished with a smaller annular rotation of the gear cage and smaller rotational travel of the shifting toggle.

Larger gear teeth are not required for biting engagement to hold the gear cage in driving engagement as the driving reaction force of the output ring 50B gear through the driving terminal gear 34B center shaft 40B to the shiftable gear cage 18B forces the gear cage in a backward rotational direction toward engagement with the input shaft 26B.

Figure 20:
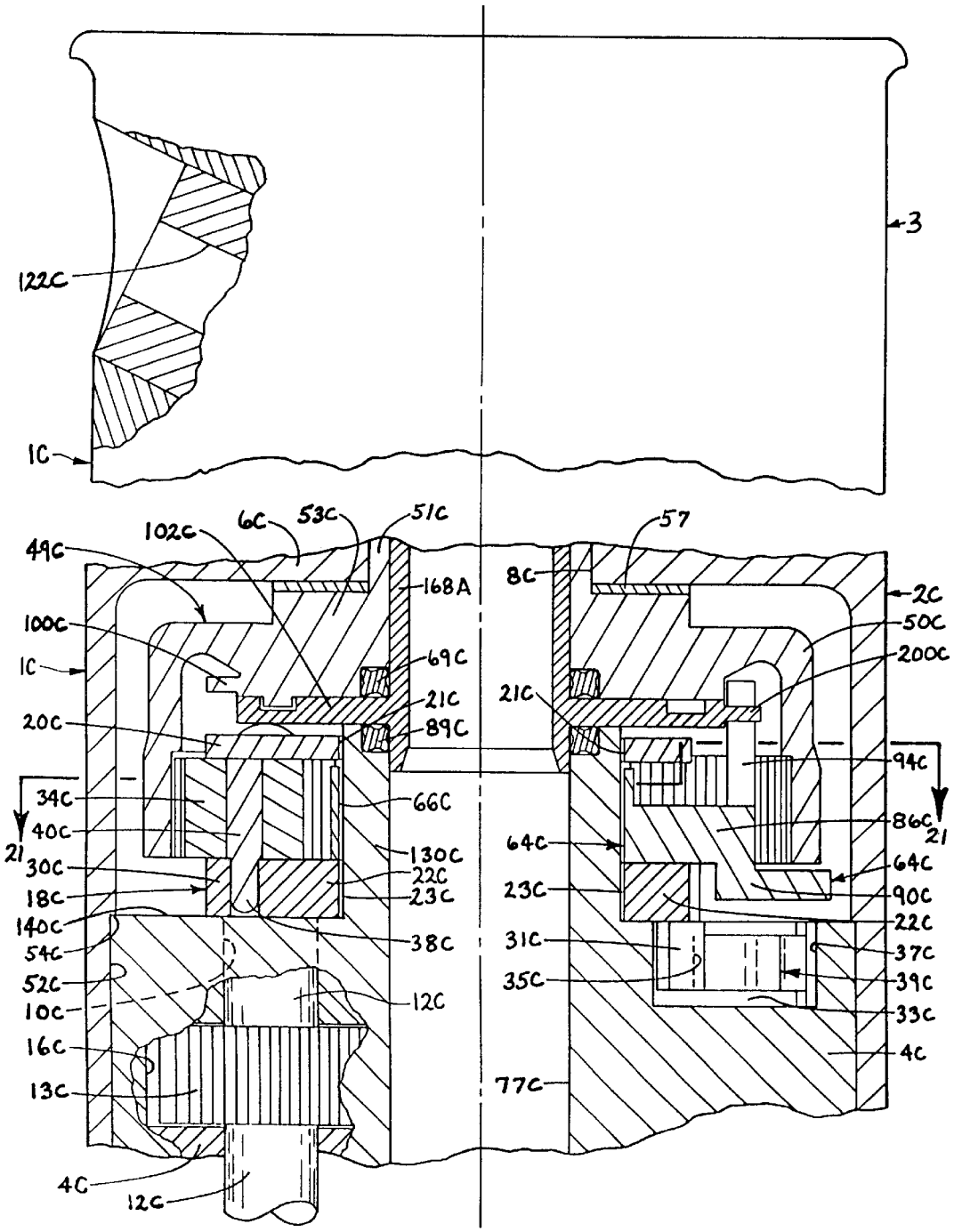
FIG. 20 is a fragmentary side elevation view taken on line 20—20 of FIG. 21 of a sprinkler showing the upper rotating nozzle and reversing drive in section for the single shiftable driving gear between two counter rotating input shafts configuration.

Referring to FIG. 20 of the drawings, a sprinkler device 1C is shown having a cylindrical housing 2C positioned over and fixed to a base member 4C. Cylindrical housing 2C has an integral mid-flange 6C having a center opening 8C for a purpose to be hereinafter described. The end of cylindrical housing 2C over base member 4C has a circumference of an increased inner diameter 52C forming an annular step 54C. Base member 4C is positioned in the increased diameter 52C of cylindrical housing 2C against the annular step 54C.

Water passes up through the center of the base member 4C through hole 17C in cylindrical member 130C and up through the hollow center of output shaft 51C into the rotating nozzle assembly 3 for ejection out of the nozzle opening 122C.

Base member 4C has an upstanding cylindrical member 130C. There is an annular groove around the inner top surface of upstanding cylindrical member 130C in which a resilient seal 89C is placed to separate the water from direct access to the gear box. Another seal 69C is placed between annular flanges 102C and 53C to prevent dirty water from entering the gear box area.

Base member 4C has two openings 10C and 11C therethrough positioned to one side and circumferentially separated from each other for receiving rotary input shafts 12C and 14C.

Below the surface 140C of base member 4C are two cavities 16C and 17C which intersect to allow gears 13C and 15C on input shafts 12C and 14C to interact and cause input shaft 14C to be driven in a reverse direction to that of input shaft 12C which is connected though its lower shaft 12C to a source of rotational power such as a water turbine enclosed in the lower part of housing 2C. The upper end of each of the counter rotating input shafts 12C and 14C are formed as spur gears 26C and 27C respectively. These spur gears are shown without teeth in FIG. 21 showing only the pitch circles and outside diameter for illustration.

The single shiftable driving gear 34C is carried on the gear cage 18C (shifting carrier) of this invention.

Figure 21:
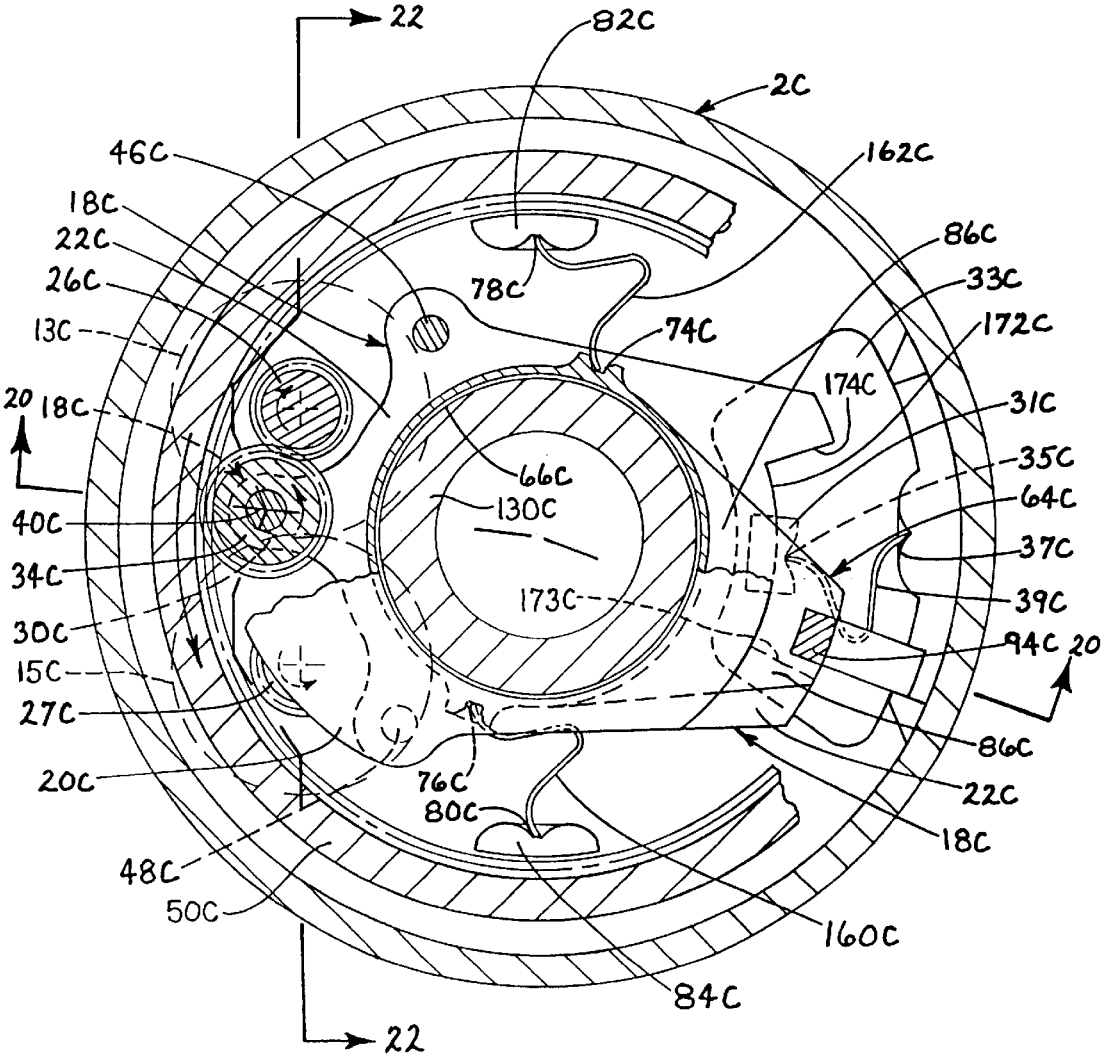
FIG. 21 is a transverse sectional view taken on line 21—21 of FIG. 20 showing the gear cage assembly in its fully clockwise position for driving the output ring gear for counter-clockwise rotation. The reversing toggle device is shown in its fully clockwise position.

As shown in FIGS. 20 and 21 this driving gear 34C is mounted on a shaft 40C extending downwardly from the gear cage top plate 20C of reversing gear cage 18C. Driving gear 34C is mounted to extend over the edge of the rib 30C of the lower gear cage plate 22C so that it can be shifted to engage either of the input shaft spur gears 26C or 27C.

The shiftable driving gear 34C is also mounted to extend over the outer edge of lower gear cage 18C rib 30C to engage the output ring gear 50C so that it may drive the output ring gear 50C in a clock wise or counter clockwise direction when it is shifted by gear cage 18C to engage input shaft spur gear 26C or 27C.

A reversing gear cage assembly, or shiftable drive assembly, 18C is positioned within said cylindrical housing 2C adjacent said base member 4C and the reversing gear cage assembly 18C is formed having a top plate 20C and bottom plate 22C with cooperating center openings 21C and 23C, respectively.

The gear cage 18C (shifting gear carrier) of this invention needs only one shiftable connecting pinion gear 34C that is shifted between engagement with one or the other of the counter rotation input shafts spur gears 26C or 27C to connect oscillating driving power to the output ring gear 50C.

The single shiftable connecting pinion gear 34C is mounted on shaft 40C extending downwardly from the top plate 20C. Posts 46C and 48C also extend down from top plate 20C and the stepped reduced diameter lower ends (38C for shaft 40C) respectively extend into matched openings in the bottom plate 22C and have a snap engagement at their ends with said openings to fix said top plate 20C and bottom plate 22C of the reversing gear cage (carrier) assembly 18C together.

As shown in FIG. 21 a notched area 172C extends across the opposite side of the center opening 23C of the lower gear cage plate 22C from where the single shiftable connecting pinion gear 34C is mounted. The shiftable driving connecting pinion 34C is mounted on its rotational center shaft 40C on an arm 30C which extends out from the center opening 23C of the lower gear cage plate 22C in between the input shaft spur gear 26C and 27C.

A reversing toggle shifting arm device 64C is positioned just above the reversing lower gear cage plate 22C and is also positioned around the cylindrical member 130C of base member 4C. The reversing toggle device 64C has a center opening 66C fitted around cylindrical member 130C at the inner end of a radial arm 86C and positioned for partial rotation around cylindrical member 130C. An actuation arm 94C extends upwardly from the radial arm 86C of toggle device 64C for contact by radial contact member 100C and 200C rotated by ring gear 50C to rotate reversing toggle device 64C in a clockwise or counter clockwise direction respectively.

On either side of the shifting arm 86C are overcenter biasing spring notches on the outer side surfaces at 74C and 76C being 180 degrees apart. Cooperating spring seat notches 78C and 80C are placed on projections 82C and 84C, extending upwardly from the top surface of base member 4C, adjacent the gear teeth of output ring gear 50C. The spring seat notches 78C and 80C are located on a diametrical line through the center line of the cylindrical housing 2, said diametrical line being 90 degrees to a line passing between the center of the cylindrical housing and bias spring notch 37C on the outside wall of cavity 33C below the top surface 140C of base member 4C.

An overcenter spring means 162C extends between spring seat notch 74C on reversing toggle device 64C and spring seat notch 78C on projection 82C of base member 4C, and a cooperating overcenter spring means 160C extends between spring seat notch 76C on the reversing toggle device 64C and spring notch 80C on projection 84C of base member 4C. Spring means 160C and 162C bias reversing toggle device 64C in a clockwise direction as viewed in FIG. 21 and in a counter clockwise direction when carried overcenter by the action of arc control contact member 100C or 200C action against the reversing toggle device 64C actuation arm 94C.

To maintain a biasing force on reversing gear cage 18C at all times, to keep the shiftable driving pinion gear 34C into driving engagement with the ring gear 50C and one of the input shafts spur gear 26C or 27C, a downwardly projecting member 31C is located on the bottom of gear cage bottom plate 22C of the reversing gear cage 18C and extends into recess 33C formed in the top of base member 4C. Downwardly projecting member 31C is located on the plate 22C below the shifting area 172C with a spring seat notch 35C facing outwardly along a radial line through the center of cylindrical member 130C. A cooperating spring notch 37C is positioned on the outer wall of recess 33C on a line passing through the center of cylindrical member 130C.

Overcenter spring 39C (and spring means 160C and 162C) are formed from ribbon-like spring material, for example steel, and shaped with an intermediate arcuate portion and oppositely directed straight portions to engage the spring seat notches.

The biasing force of overcenter spring means 39C is made less than the combined biasing force of overcenter spring means 160C and 162C at the rotation position of disengagement, so that overcenter spring means 39C will only maintain the driving gear of reversing gear cage 18C in engagement until the overcenter spring means 160C and 162C actually go overcenter and force the toggle device 64C to its overcenter other side, the toggle device 64C lower extension arm 90C then contacting the end surface 173C or 174C of the gear cage notch area 172C which constitutes a mechanical lost motion connection between reversing toggle means 64C and shiftable gear cage (carrier) 18C.

For this configuration, as shown in FIG. 20, arc control contact member 100C has been relocated from the lower left under edge of output ring gear 50C, as shown in FIG. 14, to a cylindrical flange area 53C of output drive means 49C. The location of the arc control contact members is not significant to the function of the invention. Arc of oscillation extremes contact control means only needs to cause the shifting lever device (toggle) 64C to be moved to cause the reversing action to be initiated at the appropriate arc of rotation positions. For example the desired arc extremes could be established by a second annularly displaced actuation arm such as 94C also mounted or connected to the toggle device 64C and then only one actuation member would rotate with the nozzle and output drive means 49C between the two toggle connected arc control contact means to achieve the same reversing result at a desired arc of coverage.

The rotational driving action of arc control contact member 100C or 200C as shown which do rotate with the nozzle and output drive means are moved against the actuation arm 94C of reversing toggle 64C rotationally driving the reversing toggle overcenter of its biasing springs 160C and 162C and now causing the gear cage to be rotated by the action of lower extension arm 90C contacting the end surface 173C or 174C of the gear cage notch. The gear cage 18C is now move out of driving engagement over its bias means 39C center reversing its biasing direction to now cause the connecting gear driving pinion gear 34C to be moved to engage the other counter rotating input shaft spur gear 26C or 27C and causing the output ring gear 50C to be driven in the opposite direction.

In all of the configurations disclosed in this continuation in-part application, the reaction force on the driving connecting pinion gear reversing gear cage and output gear are to hold engagement with the input shaft spur gear during driving, however a gear cage biasing spring is still provided to further ensure that as previously discussed in patent application Ser. No. 932,470, filed Nov. 18, 1986 now U.S. Pat. No. 5,417,370, that should the sprinkler nozzle output shaft be turned manually from the outside during handling installation or adjustment that it not be left with the reversing toggle positioned sufficiently off of engagement with the reversing gear cage so that the gear cage driving pinion gear teeth will not be touching the teeth of one of the input shaft spur gear 26C or 27C which would then not allow it to walk the gear cage back into the full engagement position either clockwise or counter clockwise and drive the output ring gear.

It should be noted that if the reversing toggle is not holding the gear cage driving pinion 34C into engagement with one of the input shaft spur gears 26C or 27C and there is no gear cage bias provided when the output shaft ring gear, as shown in FIG. 21, is manually rotated counter-clockwise, the driving direction, it carries the driving pinion gear 34C and gear cage counter-clockwise disengaging the driving pinion 34C from the input shaft spur gear 26C. If the nozzle and output drive gear are further manually rotated counter-clockwise driving pinion gear 34C will be carried over to engagement with input gear 27C. The reversing toggle 64C will have been lifted off of contact with the gear cage 18C and carried short of its overcenter reversing position. When the water is again turned on to the sprinkler and the input shafts start to turn the sprinkler will turn slightly in the reversed direction and stop remaining in this disengage dead center position. This is only a very small arc and the action must have been created by manual external handling.

Also the gear cage biasing spring as previously discussed can be used to provide additional rotational travel for the gear cage over that provided by the reversing toggle overcenter springs which for the configuration of springs shown the springs tend to jump out of their end notches 74C or 76C if the rotation of the reversing toggle device 64C exceeds more than 30 degrees on either side of center. Since it is desired to have a lost motion connection between the reversing toggle device 64C and the gear cage 18C where the reversing toggle springs are sufficiently overcenter before the toggle engages the reversing gear cage on the other side of center to over power the gear cage biasing spring before or as it is driving the gear cage out of engagment, a substantial amount of this available 30 degrees is consumed prior to the gear cage being contacted to move it.

The addition of the overcenter biasing spring to the gear cage thus also reduces the sensitivity of the reversing mechanism to manufacturing tolerances ensuring reliable operation under all conditions.

Figure 23:
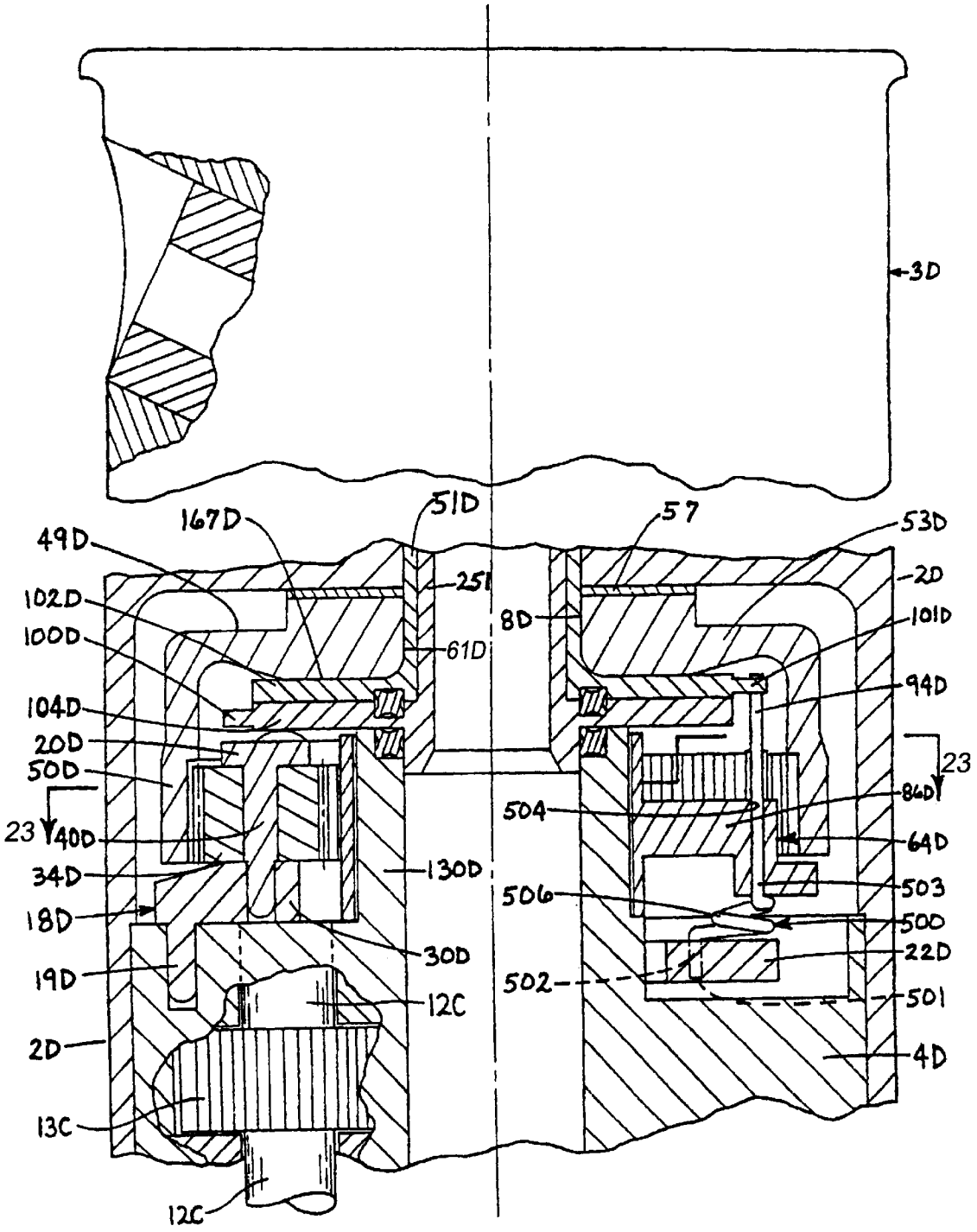
FIG. 23 is a fragmentary side elevation view taken on line 23—23 of FIG. 24 of a sprinkler showing the upper rotating nozzle and reversing drive in section for a reversing configuration where the gear cage pivot has been moved off center and a single bias spring interacts directly between the gear cage and toggle action shifting arm.
Figure 24:
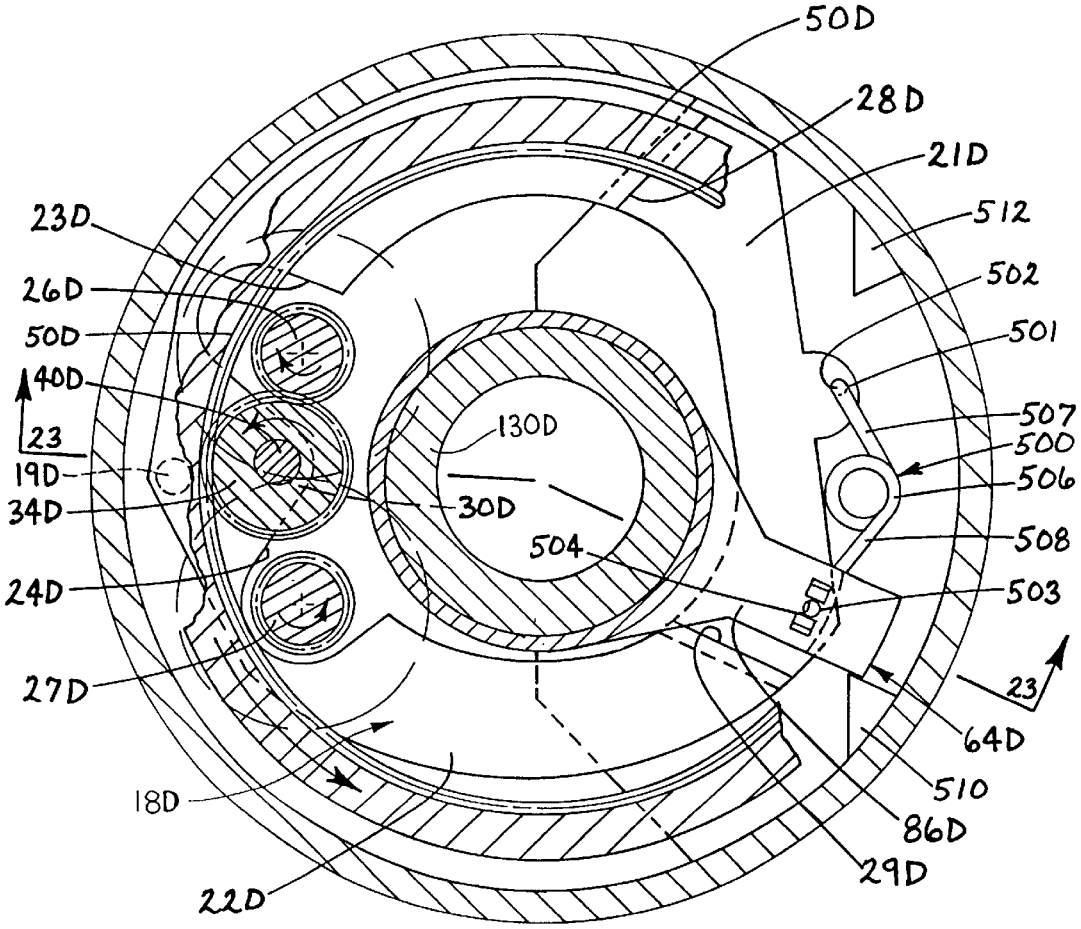
FIG. 24 is a transverse sectional view taken on line 24—24 of FIG. 23 showing the gear cage(carrier) in its full counter-clockwise position for driving the output ring gear for counter-clockwise rotation. The reversing toggle is shown in its fully clockwise position.

In the configuration shown in FIG. 23, output ring gear 50D of output driving member 49D is mounted for concentric rotation and driving engagement with output shafts 51D and 251. Driving engagement between output driving member 49D and the outer output shaft 51D is achieved by a lightly serrated frictional area 167D formed between radial flange 102D and under surface of radial flange member 53D. This arrangement provides a torque limiting clutch action.

Concentric output shafts 251 and 51D pass through the center hole 61 in the output driving member 49D, through a thrust bearing washer 57, out of cylindrical housing 2D through its center opening 8D and are locked together in a nozzle assembly 3D or may be a single piece. Means can be provided to change the angular relation of shafts 251 and 51D and respective contact members 100D and 101D, if desired.

The inner concentric output shaft 251 also has a radial annular flange 104D. Both radial flange 102D of output shaft 51D and radial flange 104D of output shaft 251 have radial contact members 101D and 100D which are arcuately positioned as desired to achieve the desired oscillation arc control by their action when contacting the actuation arm 94D of the reversing mechanism.

Figure 22:
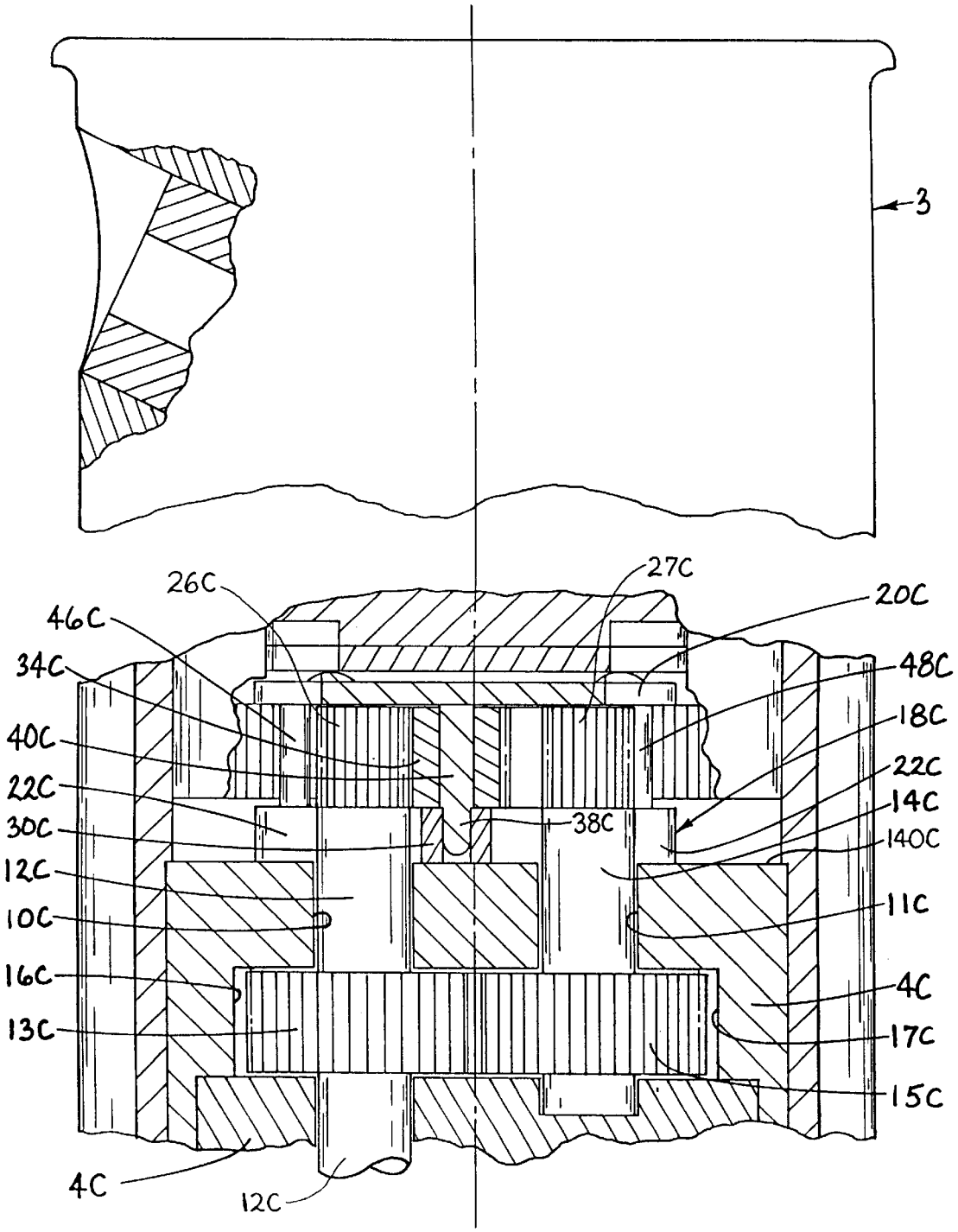
FIG. 22 is a sectional view taken on line 22—22 of FIG. 21 showing the driving relationship of the counter rotating input shafts.

In the reversing mechanism configuration shown in FIG. 22 and 23 the shiftable gear cage has only one shiftable connecting pinion gear which is alternately shifted between driving engagement with one or the other of two counter rotating input shafts as for the configuration shown in FIG. 20 and 21, however the shiftable gear cage 18D pivotal center has been moved to the outside circumference of the housing 2 and no longer has cooperating center openings for rotation about the central cylindrical member 130 of base member 4D.

The gear cage 18D now takes the form of a shiftable yoke 22D which surrounds the cylindrical member 130D and has clearance areas 23D and 24D to avoid shifting interference with counter rotating input shaft spur gear 26D and 27D.

The shiftable yoke 22D is stepped downwardly at 28D on each side connecting across on the bias spring side to allow clearance for the single biasing spring coils to pass between the toggle arm 86D and the top of the shiftable yoke 22D along the portion of the yoke. Again a single connecting pinion gear 34D is shifted from driving engagement between the output ring gear 50D and one of the counter rotating input spur gears 26D or 27D for driving the output ring gear 50D in one direction or the other. The shifting arm reversing toggle device 64D is however still rotated through its clockwise and counter clockwise shifting positions about cylindrical member 130D. However the overcenter bias is now not provided by two individual springs on either side of the toggle arm. Instead a single biasing spring 500 is provided which simultaneously biases the gear cage 18D and reversing toggle device 64D. This is now possible to have a single spring directly act on both the overcenter gear cage 18D and overcenter reversing shifting toggle arm 64D since the reversing gear cage pivot has been located to the outside of the shaft axis of the gear cage connecting driving pinion gear 34D and achieves correct driving engagement for reaction force biting engagement when it is moved in the opposite direction to that of the shifting arm toggle device 64D which must be shifted in the direction of rotation of the output shaft 51D to achieve the reversing action when contacted by arc control contact members 100D or 101D which are rotatable with the nozzle and output shafts.

A multiple coil wire gear cage biasing spring 500 is shown with one end 501 being bent down and inserted into a hole 502 in the yoke 22D at its outside center edge away from the gear cage pivot shaft 19D. The other end 503 of the wire spring 500 is bent upward and is placed through a hole 504 towards the end of the toggle shifting arm 86D away from the rotation center for the toggle device around cylindrical member 130D. This hole 504 is out-board of the hole 502 for the spring end through the shifting yoke 22D of gear cage 18D so that as the shifting arm 64D is rotated by the arc control contact means 100D or 101D contacting the upper end of the biasing spring wire end 503, which extends upward to also serve as the actuation arm 94D for the reversing toggle means 64D, the biasing spring end hole 502 in the gear cage 18D will pass hole 504 in the toggle 64D at an outside radius so that the coil 506 and legs 507 and 508 of the single biasing spring 500 will be rotated to the inside where there is adequate clearance for it to be reversed toward the inside the opposite of what is shown in FIG. 23 with the gear cage now moved fully clockwise and the reversing toggle device moved fully counter clockwise for clockwise driving of the output ring gear 50D.

Stops 510 and 512 are provided to limit the rotational travel of the reversing toggle 64D so that the connecting biasing spring 500 can now force the gear cage 18D overcenter to the other shifting position and the toggle 64D to its other overcenter reversed position.

The advantage here is the simplicity of a single biasing spring for production assembly and the simultaneous reversal of the shifting toggle arm device 64D and gear cage 18D engagement bias. The gear cage is biased into engagement up to the moment of shifting, whether the transmission is driving itself or the output shaft and ring gear are being manually positioned as may sometimes be done during installation. There is no need for the shifting toggle springs to have to overpower the gear cage bias spring.

To now describe the gear cage 18D in more detail, it consists of an upper plate 20D and a lower plate 22D or yoke. The single driving pinion gear is mounted on a shaft 40D extending downwardly from the upper plate 20D through the center of shiftable connecting driving pinion gear 34D and into a mating hole on an arm portion 30D of the lower gear cage plate 22D which extends toward the center of the housing 2D from the gear cage pivot 19D. The shiftable connecting driving pinion gear 34D overhangs the sides of arm portion 30D so as to have clearance to engage input shaft spur gear 26D or 27D.

A portion of the lower gear cage plate 22D yoke is stepped downwardly at 28D and 29D and connected with plate surface 21D to form a completely hooped yoke around cylindrical member 130D. The stepped surface at 28D and 29D can serve as an angular (rotational) stop for the gear cage to control the engagement pressure of the driving pinion gear against the input shaft spur gears 26D and 27D. Lower connecting surface 21D of the lower gear cage plate 22D or yoke provides vertical clearance space for the legs 507 and 508 and coil 506 of the biasing wire spring 500 to pass over each other during toggling.

The shiftable connecting pinion gear 34D maybe replaced by a rubber wheel if so desired which is only a friction drive providing a clutching action if the nozzle and output drive shaft are force rotated past the normal reversing stops where gear engagement in a reversed driving direction would normally have stopped further rotation in that direction instead of providing the slip clutch between the output shaft 51D and the output driving member 49D, shown for FIG. 23.

The upper end of the biasing spring wire 500 which is extending upwardly through the reversing toggle device arm 64D now serves as the toggle device actuation arm 94D which when contacted by the arc control contact member 100D or 101D carries the toggle shift device over its bias center in the direction of rotation of the driving ring gear 50D of output driving member 49D.

This wire shifting actuation arm 94D can be bent out of the way of the arc control contact members also acting as a clutch to prevent damage to the reversing mechanism during forced rotation of the sprinkler nozzle outside of the reversing limits of the transmissions.

The reversing transmission shown in FIG. 25 has the same shifting gear cage arrangement of FIG. 20 with a shiftable connecting pinion gear 34E shiftable between counter rotating input shaft spur gears 26E and 27E. There is however for the reversing transmission configuration shown in FIG. 25 no shifting arm toggle device. Instead the overcenter carry action required once the shiftable connecting driving pinion gear 34E has been driven out of engagement by the action of the arc control contact members 100E or 101E being driven against the actuation wire 94E. The actuation wire 94E is directly mounted on the lower gear cage plate 22E and is deflected an arcuate distance sufficient to carry the gear cage and its biasing spring 39E the remaining overcenter distance after disengagement occurs between the drive pinion 34E and input shaft spur gear 26E or 27E by the now stiffened actuation wire 94E when loaded against post 95E or 96E which also are shown extending upwardly from the lower gear cage plate 22E in FIG. 26. More complete details of a reversing transmission operation with this type of action is the subject matter of referenced U.S. Pat. No. 5,148,991, issued Sep. 22, 1992, and should be included into this continuation-in-part application as if fully disclosed herein.

Detail of the actuation wires stiffening posts configuration is shown in FIG. 27 where the upper arc control contact member 101E is being rotated towards the right and is shown about to contact the action wire arm 94E to deflect it to the right to contact stiffening post 95E.

To have this work properly the overcenter biasing force necessary to carry the gear cage overcenter must become less than the force necessary to disengage the shiftable driving gear as the deflection force for carry over must be accumulated against any driving reaction force on the gear cage and the gear cage biasing spring force. Once the gear cage overcenter carry action begins, the bendable actuation wire 94E force continues to diminish as it is returned to its neutral upright position while producing the overcenter carry action for the reversing gear cage.

Figure 26:
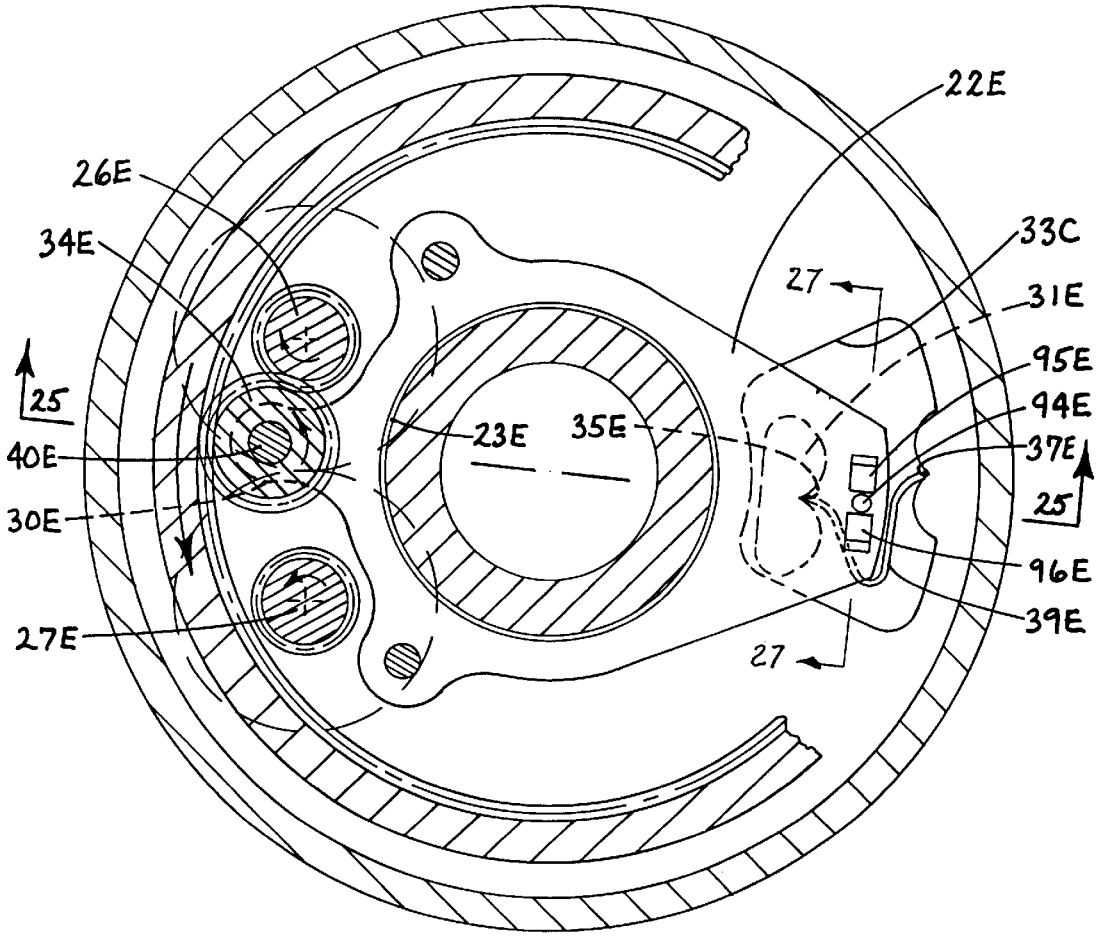
FIG. 26 is a transverse sectional view taken on line 26—26 of FIG. 25 showing the gear cage in its fully clockwise position for driving the output ring gear for counter-clockwise rotation. The shifting arm wire is shown in its vertical neutral position between its side bending limiting stiffening posts.

FIG. 28 shows a shaped cam action gear cage bias spring configuration where downwardly extending leg 31F of the gear cage configuration shown in FIG. 26 has been modified to be a triangular shaped piece 31F now interacting with the surfaces on a leaf spring 39F which enters from a cavity 401 to one side of the cavity 33F with the leaf spring position secured by its other end which encompasses a post 400 in cavity 401 of base member 4F.

The shaped end of gear cage biasing leaf spring 39F has two different slopes as shown at 402 and 403 and 404 and 405 on either side of its center positions. The gear cage shifting arcuate movement for this configuration is totally balanced with full engagement of the connecting driving pinion gear 34E occurring at the same angular displacement of the gear cage on either side of its overcenter position.

The force necessary to over power the gear cage biasing spring is greater when the gear cage camming leg 31F is engaging the steeper surface 402 or 405 of the biasing leaf spring 39F than when the spring is deflected and it is being forced over its more gradually sloped surface 403 or 404 surfaces. This is the action desired to enhance the action of the overcenter carry wire configuration of FIG. 26 which eliminated the need for an overcenter shifting toggle device part. Shaft camming surfaces for changing the biasing force on the gear cage were previously discussed for FIG. 13 of application Ser. No. 932,470, filed Nov. 18, 1986 now U.S. Pat. No. 5,417,370, the original parent application.

FIGS. 29 and 30 show a modification of FIGS. 20 and 21 to further clarify that the gear cage with the single driving gear for engaging two separate driving counter rotating input gears can be pivoted to move side to side about the axis of the output shaft with the gear cage pivot displaced off of the center axis of the output drive shaft but still inside of the radial location of the two counter rotating input shafts. Displacing the pivotal center of the shiftable gear cage increases the shifting mechanical advantage making it easier for the shifting arm toggle to move the shiftable gear cage driving terminal gear out of driving engagement. The driving reaction force is trying to keep the shiftable driving terminal gear in driving engagement until disengaged and shifted to its alternate reversed driving position.

FIG. 29 of the drawings is a cross sectional side elevation of the sprinkler device as shown in FIG. 20 modified by the addition of a different shaped gear cage 18G and a gear cage pivot shaft 700 which is displaced off of the center A of the output shafts 51C and 168A on a radius between the output shafts' center A and the centers of the counter rotating input shafts 12C and 14C (see FIG. 22). The upper ends of each of the counter rotating input shafts 12C and 14C are formed as spur gears 26C and 27C, respectively.

The shape of the shiftable gear cage 18G is changed from that shown in FIG. 21 to provide additional clearance in the center area 710 for the shiftable gear cage 18G to shift from side to side about the cylindrical member 130C (see FIG. 30) on pivot shaft 700, and to extend around the counter rotating input shafts 12C and 14C. The remainder of the gear cage 18G is formed and functions as the gear cage 18C of FIGS. 20 and 21.

The gear cage pivot shaft 700 pivots in a hole 702 through surface 140C in base member 4C. The pivot shaft 700 extends upward out of surface 140C and is fixed in hole 704 in an inwardly extending rib 30G of the lower gear cage plate 22G of the shiftable gear cage 18G. Driving gear 34G, carried by a shaft 40G mounted between top plate 20G and lower plate 22G of gear cage 18G, extends over the side edges of the rib 30G so that the driving gear 34G can be shifted around pivot shaft 700 to engage either of the spur gears 26C or 27C of counter rotating input shafts 12C and 14C. Shaft 40G has a reduced diameter lower end 38G which has a fixed snap engagement with a matched opening in the lower gear cage plate 22G. Other posts 46G and 48G extend between top plate 20G and lower gear cage plate 22G to fix said top plate 20G and lower plate 22G together.

The shaft hole 712 in driving gear 34G is slightly enlarged for a loose fit on the shiftable gear cage shaft 40G to accommodate the slight change in radius from the shaft 40G to the output ring gear 50C as the gear cage 18G rotates.

The operation of this modification of the reversing gear drive shown in FIGS. 29 and 30 is the same as described for the gear drive configuration of FIGS. 20, 21, and 22.

Thus, while I have illustrated and described my invention by means of specific embodiments, it is to be understood that numerous changes and modifications may be made therein without departing from the spirit and scope of the invention as defined in the claims.

I claim:

1. An oscillating sprinkler unit in combination with an arc control contact mechanism, comprising:

a sprinkler head mounted for a rotation; drive mechanism comprising a gear carrier with alternately operable terminal gears on said gear carrier, said gear carrier being shiftable to alternately engageable driving positions for driving said sprinkler head in alternate directions; a shifting arm movable by said arc control contact mechanism rotatable with said sprinkler head for shifting said gear carrier between said alternate engageable positions; a biasing spring pushing on said gear carrier toward engagement and retaining said gear carrier in a selected one of said alternate engageable positions until shifted from either position by said shifting arm; said arc control contact mechanism including a first arc control contact member and a second arc control contact member; said first arc control member being movable relative to said second arc control contact member to vary the amount of oscillation of said oscillating sprinkler.

2. An oscillating sprinkler unit, comprising:

a housing having a generally cylindrical configuration with a central axis, an inlet at a lower end for attachment to a source of water and an outlet at an upper end; a sprinkler head mounted on said upper end for rotation about said central axis; a drive motor mounted in said housing for driving said sprinkler head; a shiftable gear train comprising a terminal drive gear means connected to said sprinkler head; a shiftable means for alternatively shifting said terminal drive gear means alternatively into engagement with counter-rotating internal gears for driving said sprinkler head in alternate directions, said shiftable drive means including counter-rotating drive gears driven by said drive motor rotation about an axis offset from said first axis; a pivoting gear carrier mounted for pivotal movement about an axis to provide driving engagement of one or the other of said counter-rotating gears with said terminal gear; a shifting arm mounted for pivotal movement; lost motion means disposed between said shifting arm and said carrier for connecting said shifting arm to said gear carrier for shifting said terminal drive gear means to alternately engageable positions; a first overcenter biasing means for maintaining said shifting arm means in a selected one of said alternately shifting positions; and overcenter bias means applied on said pivoted gear carrier for biasing and maintaining said gear carrier in a selected one of said alternate engageable positions until said pivoted gear carrier is shifted out of engagement and carried over its bias means center by the shifting arm bias at which time the pivot gear carrier bias means force biases said pivoted gear carrier into driving engagement for rotating said terminal drive gear in the reverse direction.

3. A closed case oscillating sprinkler comprising:

a non-rotatable housing having a central axis; a rotatable sprinkler head supported to said housing and rotatably mounted about said central axis in a clockwise direction and a counterclockwise direction; a gear train in said housing coupled to said sprinkler head imparting rotary motion to said sprinkler head; a pair of angular positioning members rotatable with said sprinkler head; a shiftable carrier pivotably mounted in said sprinkler housing and shiftable to two driving positions; a shifting member; a spring connected to said shiftable carrier that is movable to an over-center position relative to the center of said spring, said shifting member alternately movable by said pair of angular positioning members to a first position and a second position and positions said spring past said center position when moving from said first position to said second position and vice versa so that said spring causes said shiftable carrier to alternately move to either of said two driving positions when said shifting member causes said spring to pass over said center position, and said spring imposing a load in a direction to drive said shiftable carrier into driving position in one of said alternate driving positions when said sprinkler head is rotating in the clockwise direction until shifted therefrom or in the counterclockwise direction until shifted therefrom.

4. A closed case oscillating sprinkler as claimed in claim 3, wherein said spring has at least two ends, and one end of said spring is movable to an over-center position for causing said shiftable carrier to move toward said respective driving positions.

5. A closed case oscillating sprinkler as claimed in claim 4, including an output gear in said gear train and a pair of terminal gears mounted on said shiftable carrier alternately engaging said output gear and said output gear is in driving relationship to said nozzle head.

6. A closed case oscillating sprinkler as claimed in claim 5, including at least one additional spring interconnected to said shifting carrier and said housing for alternately urging said shifting carrier towards one or the other of said two driving positions.

7. A closed case oscillating sprinkler comprising:

a housing for receiving a supply of water; a nozzle head directing the flow of water from said housing for irrigation proposes, said nozzle head having a top portion, a rotatable output shaft in said housing drivingly connected to said nozzle head, a gear train in said housing for rotating said output shaft and a shiftable member moveable to two positions operatively connected to said gear train to cause said gear train to rotate in a clockwise and counterclockwise direction; a first arc control contact member and a second arc control contact member rotatable with said nozzle head, said first arc control member being settable and rotatable relative to said second arc control member to set the angle of oscillation of said nozzle head; a shaft extending to said top portion of said nozzle head operatively connected to said first arc control contact member and accessible at said top portion, wherein the rotational relationship of said shaft and said first arc control contact member is substantially equal to a ratio of one to one and said shiftable member is alternately engageable with said first arc control contact member and said second arc control contact member so as to oscillate said sprinkler through the angle of oscillation as a function of the setting of said first control contact member.

8. A closed case oscillating sprinkler as claimed in claim 7, including indicia on said nozzle head indicative of the amount of change of said first arc control contact member relative to said second arc control contact member.

9. A closed case oscillating sprinkler as claimed in claim 8, wherein said indicia is indicative of the angle of oscillation.

10. A closed case oscillating sprinkler as claimed in claim 8, wherein said indicia is located on the top of said sprinkler head.

11. A closed case oscillating sprinkler as claimed in claim 9, wherein said indicia is located on the top of said sprinkler head.

12. An oscillating sprinkler of the closed case type having a nozzle that discharges water over a segment of ground intended to be irrigated, said oscillating sprinkler comprising:

a fixed housing and an oscillating nozzle head; a settable shaft rotatably mounted in said nozzle head and accessible from the exterior of said sprinkler; a pair of arc control contact members rotated with said nozzle head, one of said pair of arc control contact members being operatively connected to said settable shaft so that the rotation of said settable shaft sets the position of said arc control contact member, said one of said pair of arc control contact members being in a substantially one to one rotational relationship with said settable shaft so that the position of said pair of arc control contact members relative to each other defines the arc of rotation of said sprinkler commensurate with the segment of ground intended to be irrigated, the position of said settable shaft being visible from the exterior of said oscillating sprinkler and being indicative of the arc of rotation being set.

13. An closed case oscillating sprinkler of the closed case type as claimed in claim 12, including indicia on said nozzle head indicative of the angle that said nozzle head oscillates.

14. A rotary drive sprinkler device comprising:

a housing for receiving a supply of water;

an oscillating nozzle head for directing said supply of water for irrigation, said nozzle head having a top;

a rotatable output shaft in said housing, said output shaft being drivingly connected to said nozzle head;

an oscillating output rotary drive in said housing for driving said output shaft;

a shaft in the nozzle head;

a pair of settable arc of oscillation contact members rotationally settable relative to each other by said shaft in the nozzle head and accessible from said top;

a shiftable plate that has two driving positions;

a spring exerting a force on said shiftable plate to alternately hold said shiftable plate in one or the other of the two driving positions;

an actuator, said actuator alternately movable by said arc of oscillation contact members for shifting said shiftable plate; and said shaft in the nozzle head and pair of settable arc of oscillation contact members being in substantially a one to one relationship whereby a rotation of said shaft represents substantially like rotation of said at least one of said settable arc of oscillation contact members.

15. An oscillating sprinkler as claimed in claim 14, wherein said spring moves said shiftable plate into one and then the other of said driving positions to alternately hold said shiftable plate.

16. A closed case oscillating sprinkler comprising:

a housing for receiving a supply of water; a nozzle head directing the flow of water from the housing for irrigation purposes, said nozzle head having a top portion, a rotatable output shaft in said housing drivingly connected to said nozzle head, a gear train in said housing for rotating said output shaft and a shiftable member movable to two positions operatively connected to said gear train to cause said gear train to rotate in a clockwise and counterclockwise direction; a first arc control contact member and a second arc control contact member rotatable with said nozzle head, said first arc control contact member being settable and rotatable relative to said second arc control contact member to set the angle of oscillation of said nozzle head; a shaft extending to said top portion of said nozzle head operatively connected to said first arc control contact member and accessible at said top portion to rotate said first arc control contact member, wherein the rotation of said shaft rotates said first arc control contact member the same amount, said second arc control contact member being fixed, and said shiftable member is alternately shifted by the action of said first arc control contact member and said second arc control contact member so as to oscillate said sprinkler through the angle of oscillation as a function of said setting of said first arc control contact member.

17. A closed case oscillating sprinkler as claimed in claim 16, including indicia on said nozzle head indicative of the amount of change of said first arc control contact member relative to said second arc control contact member.

18. A closed case oscillating sprinkler as claimed in claim 17, wherein said indicia is indicative of the angle of oscillation of said nozzle head.

19. A closed case oscillating sprinkler as claimed in claim 17, wherein said indicia is located on the top of said sprinkler head.

20. An oscillating sprinkler unit in combination with an arc control contact mechanism, comprising:

a sprinkler head mounted for rotation; a drive mechanism comprising a gear carrier with alternately operable terminal gears on said gear carrier, said gear carrier being shiftable to alternately engageable driving positions for rotating said sprinkler head in alternate directions; a shifting arm movable by said arc control contact mechanism rotatable with said sprinkler head for shifting said gear carrier to the alternately engageable driving positions; at least one first biasing spring causing said gear carrier to be pushed into one or the other of the alternate driving positions and causing said gear carrier to be retained in one or the other of the alternate driving positions until shifted for driving in the other of the alternate driving positions by the action of said shifting arm; said arc control contact mechanism including a first arc control contact member and a second arc control contact member; said first arc control member being movable relative to said second arc control contact member to vary the amount of oscillation of said oscillating sprinkler.

21. An oscillating sprinkler as claimed in claim 20, including indicia on said nozzle head indicative of the amount of change of said first arc control contact member relative to said second arc control contact member.

22. An oscillating sprinkler as claimed in claim 21, wherein said indicia is indicative of the angle of oscillation.

23. An oscillating sprinkler as claimed in claim 22, wherein said indicia is located on the top of said sprinkler head.

24. An oscillating sprinkler as claimed in claim 20, including at least one second biasing spring interconnected to said shifting arm for alternatively causing said shifting arm to shift said gear carrier towards one or the other of the alternate driving positions.

25. An oscillating sprinkler as claimed in claim 20, wherein the exterior of said sprinkler head includes indicia to allow reading the angle of oscillation that has been set.

26. An oscillating sprinkler as claimed in claim 20, having a shaft in said nozzle head for setting the relative positions of said arc control contact members, wherein the positions of said settable shaft arc visible from the exterior of said sprinkler head and whose rotation represents a like angular rotation of said first arc control contact member relative to said second arc control contact member.

27. An oscillating sprinkler as claimed in claim 24, wherein said at least one first and second biasing springs are over-center springs.

28. An oscillating sprinkler as claimed in claim 20, including a lost motion connection between said shifting arm and said gear carrier such that said shifting arm may be rotationally moved a distance before it pulls said gear carrier out of driving engagement prior to being shifted to one of the alternate driving positions.

29. An oscillating sprinkler as claimed in claim 26, wherein the position of said settable shaft indicates the arc of rotation being set.

30. An oscillating sprinkler as claimed in claim 20, where said shifting arm is pivoted around a central axis of said sprinkler.

31. An oscillating sprinkler as claimed in claim 20, where said at least one first spring is a coil spring having at least a first leg and a second leg, with said at least first leg operatively connected to said gear carrier and said at least second leg operatively connected to said shifting arm.

32. An oscillating sprinkler as claimed in claim 20, wherein said at least one first biasing spring pushing on said gear carrier is movable to over-center action positions relative to the center of said at least one first biasing spring, said shifting arm alternately movable by said pair of arc control contact members to a first position and a second position, and positions said at least one first biasing spring when moving from said first position to said second position and vise versa so that said at least one first biasing spring causes said gear carrier to alternately move to either one of the alternate driving positions when said shifting arm causes said at least one first biasing spring to pass over said over-center action position, and said at least one first biasing spring imposing a load in a direction to drive said gear carrier into one of the alternate driving positions and hold it in such position when said sprinkler head is rotating in one of the alternate directions until shifted therefrom or in the other of the alternate directions until shifted therefrom.

33. An oscillating sprinkler unit, comprising:

a housing having a generally cylindrical configuration with a central axis, an inlet at a lower end for attachment to a source of water and an outlet at an upper end; a sprinkler head mounted on said upper end for rotation about said central axis; a drive motor mounted in said housing for rotating said sprinkler head in alternate directions; a terminal drive gear operationally connected to said sprinkler head; a shiftable drive including counter-rotating drive gears driven by said drive motor, said shiftable drive for alternatively driving said terminal drive gear in alternative driving positions with one or the other of said counter-rotating gears for rotating said sprinkler head in the alternate directions; a carrier mounted for pivotal movement about an axis offset from said first axis to provide driving engagement of one or the other of said counter-rotating gears with said terminal gear; a shifting arm mounted for pivotal movement; a lost motion action mechanism located between said shifting arm and said carrier for connecting said shifting arm movement to said carrier for shifting said carrier; at least one first spring causing said shifting arm to be biased towards one or the other of said alternate driving positions; and at least one second spring causing said gear carrier to be biased and maintained in a selected one of said alternate driving positions, whereby said at least one first spring causes said shifting arm to shift said carrier over its shifting center at which time said at least one second spring carries said carrier into driving engagement for engaging said terminal drive gear into one of the alternate driving positions.

34. An oscillating sprinkler unit as claimed in claim 33, wherein at least one first and second springs are over-center springs.

35. An oscillating sprinkler unit as claimed in claim 34, wherein said shifting arm shifts said carrier by carrying said at least one second over-center.

36. An oscillating sprinkler unit as claimed in claim 35, wherein said shifting arm shifts said carrier out of engagement after said at least one second spring is carried over-center.

37. An oscillating sprinkler of the closed type having a nozzle that oscillates and discharges water over a segment of ground intended to be irrigated, said oscillating sprinkler comprising:

a oscillating nozzle head; a pair of arc control contact members rotated by said nozzle head, the position of said pair of arc control contact members relative to each other defining the nozzle head's angle of oscillation; and a rotatable shaft accessible from the exterior of said sprinkler, said shaft being operatively connected to at least one of said arc contract members so that the rotation of said shaft sets the position of said at least one of said arc control contact members in substantially a one to one manner.

38. An oscillating sprinkler as claimed in claim 37, wherein the exterior of said sprinkler includes indicia to indicate said nozzle head's angle of oscillation.

39. An oscillating sprinkler as claimed in claim 37, wherein the exterior of said sprinkler includes indicia to indicate the amount said shift is rotated.

40. A rotary drive sprinkler device comprising:

a housing for receiving a supply of water;

an oscillating nozzle head for directing said supply of water for irrigation, said nozzle head having a top;

a rotatable output shaft in said housing, said output shaft being drivingly connected to said nozzle head;

an oscillating output rotary drive in said housing for driving said output shaft;

a pair of settable arc of oscillation contact members rotationally settable relative to each other, the position of said pair of arc of oscillation contact members relative to each other defining the arc of oscillation of said oscillating nozzle head;

a shiftable member having two driving positions;

a spring exerting a force on said shiftable member to alternately hold said shiftable member in one or the other of the two driving positions until shifted to the other driving position;

an actuator mechanism, said actuator alternately movable by said arc of oscillation contact members for shifting said shiftable member; and a rotatable shaft located in said nozzle head and operatively connected to at least one of said settable arc of oscillation contact members, wherein said shift rotation represents substantially a like rotation of said at least one of said settable arc of oscillation contact members.

41. A sprinkler as claimed in claim 40, wherein said spring moves said shiftable member into one and then the other of the two alternate driving positions for causing said oscillating output rotary drive to drive said output shaft in opposite directions.

42. A sprinkler as claimed in claim 40, including indicia on of said nozzle head top indicative of the position of said first arc control contact member relative to said second arc control contact member.

43. A sprinkler as claimed in claim 40, wherein the rotational position of said rotatable shaft is indicated on the exterior of said oscillating nozzle head.

44. A closed case oscillating sprinkler as claimed in claim 43, wherein the rotational position of said shaft extending to the top portion of said nozzle is visible from the exterior of said nozzle head.

45. A closed case oscillating sprinkler comprising:

a non-rotatable housing having a central axis; a rotatable sprinkler head located proximate to said housing and rotatably mounted about said central axis to rotate in a clockwise direction and a counterclockwise direction; a gear train in said housing coupled to said sprinkler head imparting rotary motion to said sprinkler head; a pair of angular positioning members rotatable with said sprinkler head; a shiftable carrier pivotably mounted in said sprinkler housing and shiftable to two alternate driving positions; a shifting member; a spring operatively connected to said shiftable carrier that is movable to an over-center position relative to the center of said spring, said shifting member alternately movable by said pair of angular positioning members to a first position and a second position and positions said spring past said center position when moving from said first position to said second position and vise versa so that said spring can cause said shiftable carrier to alternately move to either of the two alternate driving positions when said shifting member causes said spring to pass over said center position, said spring imposing a load in a direction to drive said shiftable carrier into one of the two alternate driving positions and hold said shiftable carrier in the one of the two alternate driving positions to cause said sprinkler head to rotate in the clockwise direction until said shiftable carrier is shifted to the other of the two driving positions to cause said sprinkler head to rotate in the counterclockwise direction.

46. A closed case oscillating sprinkler as claimed in claim 45, wherein said spring has at least two ends and one end of said spring is movable to an over-center position for causing said shiftable carrier to move toward one of the two alternate driving positions.

47. A closed case oscillating sprinkler as claimed in claim 45, including a lost motion connection between said shifting member and said shiftable carrier such that said shifting member may be rotationally moved a distance before it directly contacts said shiftable carrier for pulling it out of driving engagement prior to being shifted to one of the two alternate driving positions.

48. A closed case oscillating sprinkler as claimed in claim 47, where said shifting arm is pivoted around said central axis of said sprinkler.

49. A closed case oscillating sprinkler as claimed in claim 46, where said spring is a coil spring with one leg directly connected to said shiftable carrier and the other leg operationally connected to said shifting member.

50. An oscillating sprinkler of the closed type having a nozzle that discharges water over a segment of ground intended to be irrigated, said oscillating sprinkler comprising:

an oscillating nozzle head; a settable shaft rotatably mounted in said nozzle head; a pair of arc control contact members rotatable with said nozzle head, the position of said pair of arc control contact members relative to each other defining the arc of rotation of said sprinkler commensurate with the segment of ground intended to be irrigated; at least one of said pair of arc control contact members being operatively connected to said settable shaft so that the rotation of said settable shaft sets the position of said at least one arc control contact member, said at least one arc control contact member being in a substantially one to one rotational relationship with said settable shaft.

51. An oscillating sprinkler as claimed in claim 50, wherein said settable shaft is accessible from the exterior of said sprinkler.

52. An oscillating sprinkler as claimed in claim 51, wherein the position of said settable shaft is visible from the exterior of said oscillating sprinkler.

53. An oscillating sprinkler as claimed in claim 52, wherein the position of said settable shaft indicates the arcof rotation being set.

54. An oscillating sprinkler as claimed in claim 50, wherein said settable shaft is directly rotated to set the position of said at least one arc control contact member.

55. A closed case oscillating sprinkler as claimed in claim 7, wherein said shaft extending to said top portion of said nozzle head is operatively connected to said first arc control contact member and accessible at said top portion to rotate said first arc control contact member.

56. An oscillating sprinkler as claimed in claim 37, wherein the exterior of said sprinkler includes indicia to read said nozzle head's angle of oscillation.

57. An oscillating sprinkler as claimed in claim 37, wherein the exterior of said sprinkler includes indicia to read the amount said shaft is rotated.

58. An oscillating sprinkler unit, comprising:

a housing having a generally cylindrical configuration with a central axis, an inlet at a lower end for attachment to a source of water and an outlet at an upper end; a sprinkler head mounted on said upper end for rotation about said central axis; a drive motor mounted in said housing; a terminal drive gear operationally connected to said sprinkler head to cause said sprinkler head to rotate in alternate direction; at least two counter-rotating drive gears driven by said drive motor, said gears for driving said terminal drive gear in alternate driving positions by engaging said terminal drive gear with one or the other of said counter-rotating gears for causing said sprinkler head to rotate in the alternate directions; a carrier mounted for pivotal movement about an axis offset from said first axis to engage said terminal gear in one or the other of the alternate driving positions by causing one or the other of said counter-rotating gears to engage said terminal gear; a shifting arm mounted for pivotal movement to cause said carrier to engage said terminal gear in one or the other of the alternate driving positions; at least one first spring causing said shifting arm to bias said carrier towards engaging said terminal gear in one or the other of the alternate driving positions; and at least one second spring causing said gear carrier to bias and maintain said terminal gear in one or the other of the alternate driving positions.

59. An oscillating sprinkler unit as claimed in claim 58, wherein said at least two counter-rotating drive gears are supported by said carrier.

* * * * *